US008020624B2

(12) United States Patent
Ocalan et al.

(10) Patent No.: US 8,020,624 B2
(45) Date of Patent: Sep. 20, 2011

(54) SUBMERSIBLE PUMPING SYSTEM

(75) Inventors: Murat Ocalan, Cambridge, MA (US); Steven Dornak, Damon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 681 days.

(21) Appl. No.: 11/676,275

(22) Filed: Feb. 17, 2007

(65) Prior Publication Data

US 2007/0183900 A1 Aug. 9, 2007

Related U.S. Application Data

(63) Continuation-in-part of application No. 11/308,623, filed on Apr. 13, 2006, now Pat. No. 7,469,748.

(60) Provisional application No. 60/595,012, filed on May 27, 2005.

(51) Int. Cl.
*E21B 43/00* (2006.01)

(52) U.S. Cl. ..... 166/372; 166/68; 166/105; 417/395; 417/539

(58) Field of Classification Search ..... 166/358, 166/68, 68.5, 106, 370, 372, 373, 381, 386, 166/105; 417/394, 395, 539
See application file for complete search history.

(56) References Cited

U.S. PATENT DOCUMENTS

| | | | | | |
|---|---|---|---|---|---|
| 2,435,179 | A * | 1/1948 | McGovney | 166/106 |
| 3,039,309 | A * | 6/1962 | Vesper et al. | 73/863.24 |
| 3,148,624 | A * | 9/1964 | Baldwin | 417/339 |
| 3,955,557 | A * | 5/1976 | Takagi | 600/16 |
| 4,439,112 | A * | 3/1984 | Kitsnik | 417/383 |
| 6,017,198 | A * | 1/2000 | Traylor et al. | 417/390 |
| 6,345,962 | B1 * | 2/2002 | Sutter | 417/394 |
| 6,464,476 | B2 * | 10/2002 | Ross et al. | 417/478 |
| 6,595,280 | B2 * | 7/2003 | Traylor | 166/105.5 |
| 6,889,765 | B1 * | 5/2005 | Traylor | 166/105.5 |
| 2004/0188096 | A1 * | 9/2004 | Traylor | 166/369 |
| 2005/0142005 | A1 * | 6/2005 | Traylor | 417/394 |
| 2006/0153703 | A1 * | 7/2006 | Morriss et al. | 417/394 |
| 2008/0190729 | A1 * | 8/2008 | Stehr et al. | 192/85 R |

* cited by examiner

*Primary Examiner* — Thomas A Beach
*Assistant Examiner* — Matthew R Buck
(74) *Attorney, Agent, or Firm* — Jim Patterson; Kevin McGoff; Tim Curington

(57) ABSTRACT

A technique is provided for pumping fluids in a subterranean wellbore. A submersible pumping system can be deployed in a wellbore for moving desired fluids within the wellbore. The pumping system energizes the desired fluid movement by reciprocating a working fluid between expandable members.

6 Claims, 29 Drawing Sheets

SUBMERSIBLE PUMPING SYSTEM

CROSS-REFERENCE TO RELATED APPLICATION

The present document is a continuation-in-part of U.S. application Ser. No. 11/308,623, filed Apr. 13, 2006, which is based on and claims priority to U.S. Provisional Application Ser. No. 60/595,012, filed May 27, 2005.

BACKGROUND

Well completions are used in a variety of well related applications involving, for example, the production or injection of fluids. Generally, a wellbore is drilled, and completion equipment is lowered into the wellbore by tubing or other deployment mechanisms. The wellbore may be drilled through one or more formations containing desirable fluids, such as hydrocarbon based fluids.

In many of these applications, a fluid is pumped to a desired location. For example, pumping systems can be used to pump fluid into the wellbore and into a surrounding reservoir for a variety of injection or other well treatment procedures. However, pumping systems also are used to artificially lift fluids from subterranean locations. For example, submersible pumping systems can be located within a wellbore to produce a well fluid to a desired collection location, e.g. a collection location at the Earth's surface. However, depending on the specific type of conventional submersible pumping system used for a given application, such systems can suffer from a variety of detrimental characteristics, including relatively low system efficiency, high capital cost, and/or less than desired reliability.

SUMMARY

In general, the present invention provides a system and method for pumping fluids in a subterranean environment, such as in a wellbore. A submersible pumping system is used to move a desired fluid, such as a hydrocarbon based fluid produced from a reservoir. The pumping system comprises a pump that utilizes a contained working fluid to positively displace the desired fluid. Movement of the contained working fluid is directed by a control system having uniquely arranged valves that automatically direct flow along repetitive flow paths.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in all embodiments set forth herein, the "diaphragms" (e.g., as used in chambers and reference chambers) may be substituted with "dynamic seals".

The present invention generally relates to pumping systems, such as those used in subterranean environments to move fluids to a desired location. The pumping systems utilize a plurality of expandable members that are sequentially expanded and contracted to sequentially discharge and intake the desired fluid. For example, a pumping system may be deployed in a wellbore to produce a specific reservoir fluid or fluids. As the expandable members are sequentially contracted and expanded, well fluid is drawn into the pumping system and then discharged, i.e. pumped, from the pumping system to a desired collection location.

Figure 1:
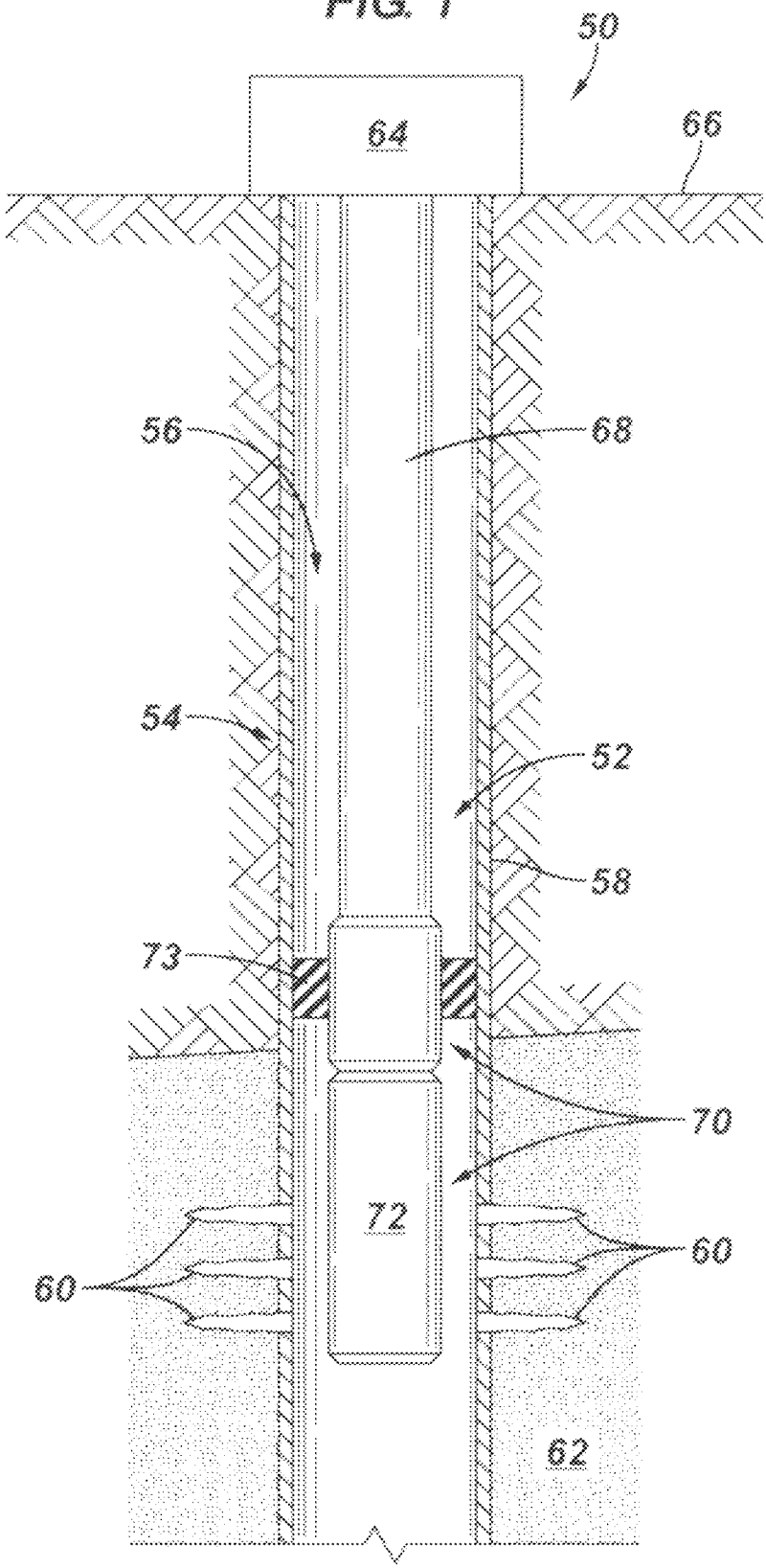
FIG. 1 is a front elevation view of a pumping system deployed in wellbore, according to an embodiment of the present invention.

Referring generally to FIG. 1, a well system 50 is illustrated as comprising a pumping system 52 in the form of a well completion deployed for use in a well 54 having a wellbore 56. The wellbore 56 may be lined with a wellbore casing 58 having perforations 60 through which a well fluid, e.g. oil, enters wellbore 56 from the surrounding formation 62. Pumping system 52 is deployed in wellbore 56 below a wellhead 64 disposed at a surface location 66, such as the surface of the Earth or a seabed floor.

In this embodiment, pumping system 52 is located within the interior of wellbore casing 58 and comprises a deployment system 68, such as a tubing, and a plurality of completion components 70. For example, pumping system 52 may comprise a pumping unit 72 and one or more packers 73 to separate wellbore 56 into different zones. The particular embodiment illustrated utilizes pumping unit 72 to produce a well fluid upwardly through tubing 68 to a desired collection point located at, for example, surface location 66.

Figure 2:
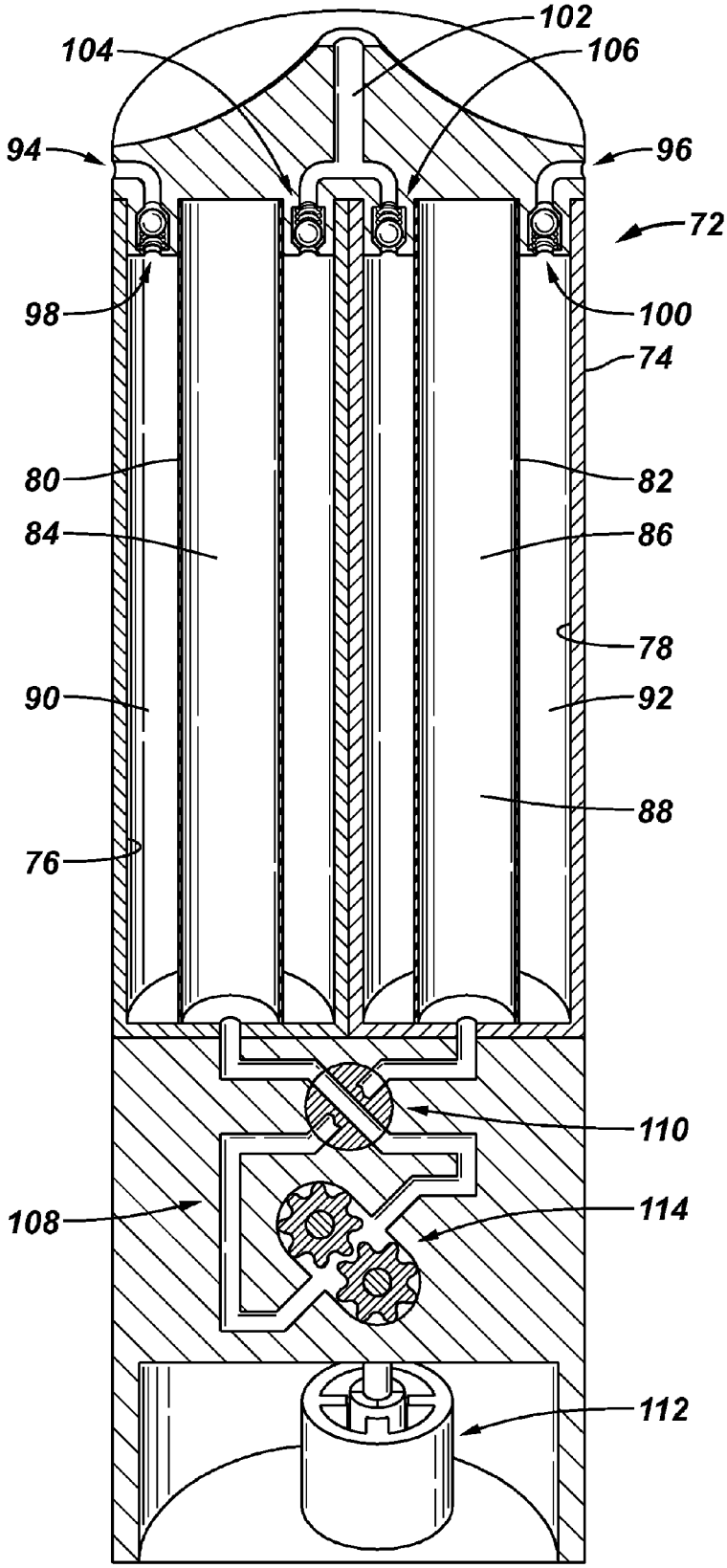
FIG. 2 is a cross sectional view of a pump embodiment that can be utilized with the pumping system illustrated in FIG. 1, according to an embodiment of the present invention.

Referring generally to FIG. 2, one example of pumping unit 72 is illustrated according to an embodiment of the present invention. The pumping unit 72 is used for energizing a pumped fluid, e.g. oil or water, in wellbore 56. Pumping unit 72 comprises a pump housing 74 having a diameter selected to facilitate deployment in a wellbore. Pump housing 74 encloses a plurality of pump chambers, such as pump chambers 76 and 78, formed therein. A plurality of expandable members 80, 82 are arranged within pump chambers 76, 78 in a manner that defines corresponding working fluid sub-chambers 84, 86, for containing a working fluid 88, and pumped fluid sub-chambers 90, 92. One type of expandable member 80, 82 is a flexible diaphragm that expands upon filling with working fluid 88 and contracts upon withdrawal of working fluid 88. It should be noted that the pump chambers and/or the expandable members may be incorporated into the design in greater number than the illustrated pair.

Pump housing 74 further comprises at least one fluid inlet, such as fluid inlets 94, 96, for conducting pumped fluid, i.e. well fluid, from the wellbore 56 into the pumped fluid sub-chambers 90, 92. Check valves 98 and 100 are used to ensure one-way flow of fluid from the wellbore into the pumped fluid sub-chambers. The pump housing 74 further comprises at least one fluid outlet, such as fluid outlet 102, through which energized, pumped fluid is conducted from pumped fluid sub-chambers 90, 92 to, for example, tubing 68 for conveyance to a collection location. The one or more outlets 102 are protected by corresponding check valves, such as check valves 104, 106, which ensure one way flow of fluid from the pumped fluid sub-chambers into the appropriate fluid conveyance mechanism, e.g. tubing 68.

The pumping unit 72 further comprises a working fluid hydraulic network 108 which contains a fixed volume of working fluid 88 and provides conduits to route the working fluid between the working fluid sub-chambers 84 and 86. The working fluid 88 may comprise a variety of types of fluids, including mineral oil, synthetic oil, perfluorinated liquids, water-based lubricant, oil-based lubricant, water-glycol mixture, organic oils and other appropriate fluids. A control valve 110 is provided to control the flow of working fluid and maybe actuated between operating positions. For example, control valve 110 can be set in a first position in which working fluid 88 is directed from working fluid sub-chamber 84 and into working fluid sub-chamber 86 to expand expandable member 82. When the working fluid 88 is to be reciprocated, control valve 110 is actuated to a second position in which the working fluid 88 is directed from working fluid sub-chamber 86 and into working fluid sub-chamber 84 to expand expandable member 80. An actuator, as discussed in greater detail below, is provided to shift the control valve 110 back and forth between the first and second operating positions. A prime mover 112 is used to drive a working fluid pump 114 which moves the working fluid 88 through the hydraulic network 108. Prime mover 112 and pump 114 can be contained within pump unit housing 74. Additionally, the prime mover 112 may be constructed in a variety of forms, e.g. an electric motor, a hydraulic motor, a mechanically actuated motor, a pneumatic motor or other appropriate mechanisms for providing energy to working fluid pump 114. Power may be provided to the prime mover through an appropriate power line, such as an electric line or a hydraulic line, routed along deployment system 68, as known to those of ordinary skill in the art. Accordingly, the pumping system comprises a contained working fluid network and a cooperating pumped fluid network.

Figure 3:
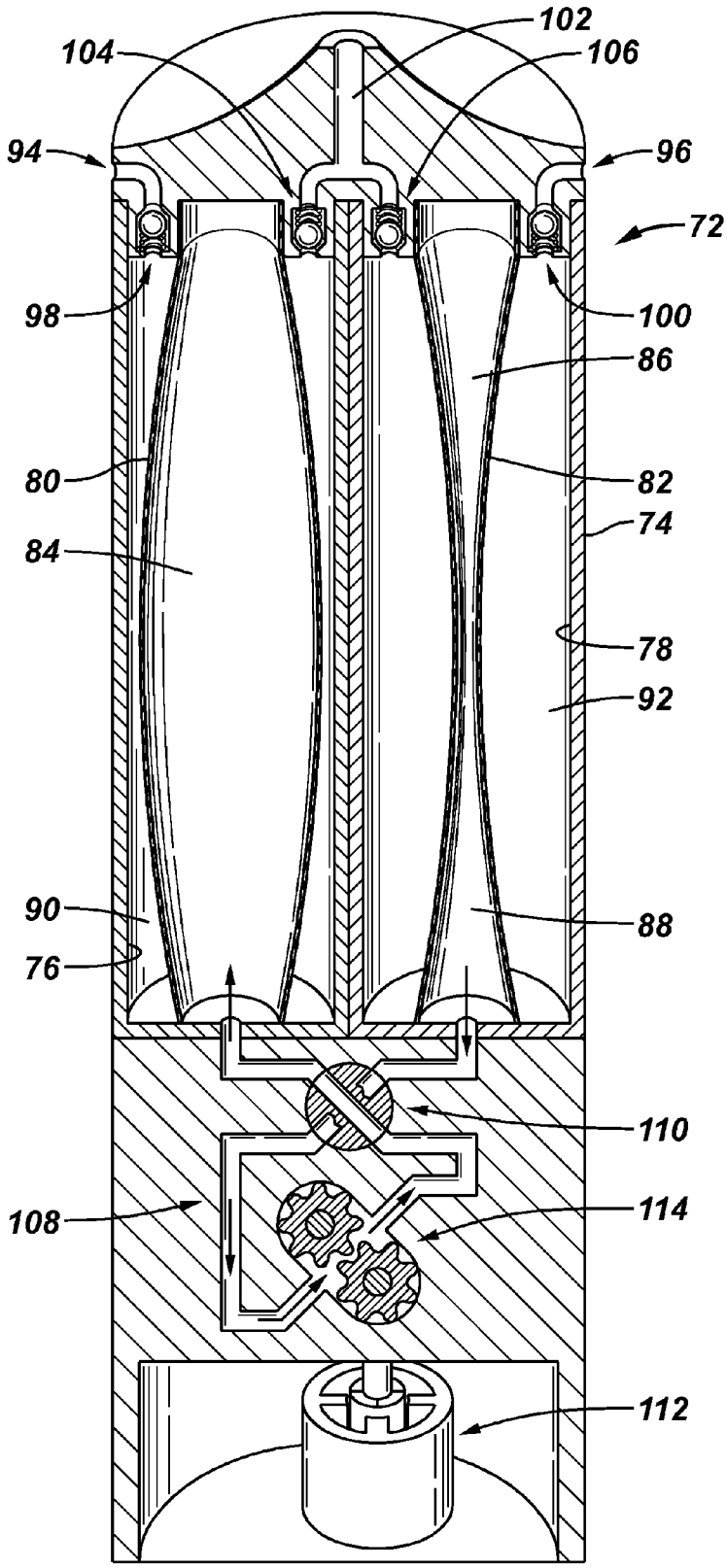
FIG. 3 is view similar to that in FIG. 2 but showing the pump in a different operational state, according to an embodiment of the present invention.
Figure 4:
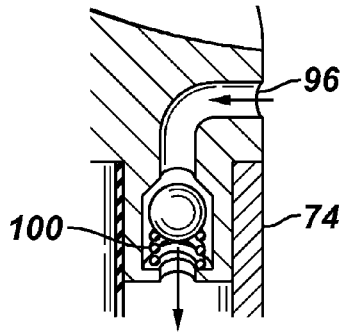
FIG. 4 is an enlarged view of a portion of the pump illustrated in FIG. 3, according to an embodiment of the present invention.
Figure 5:
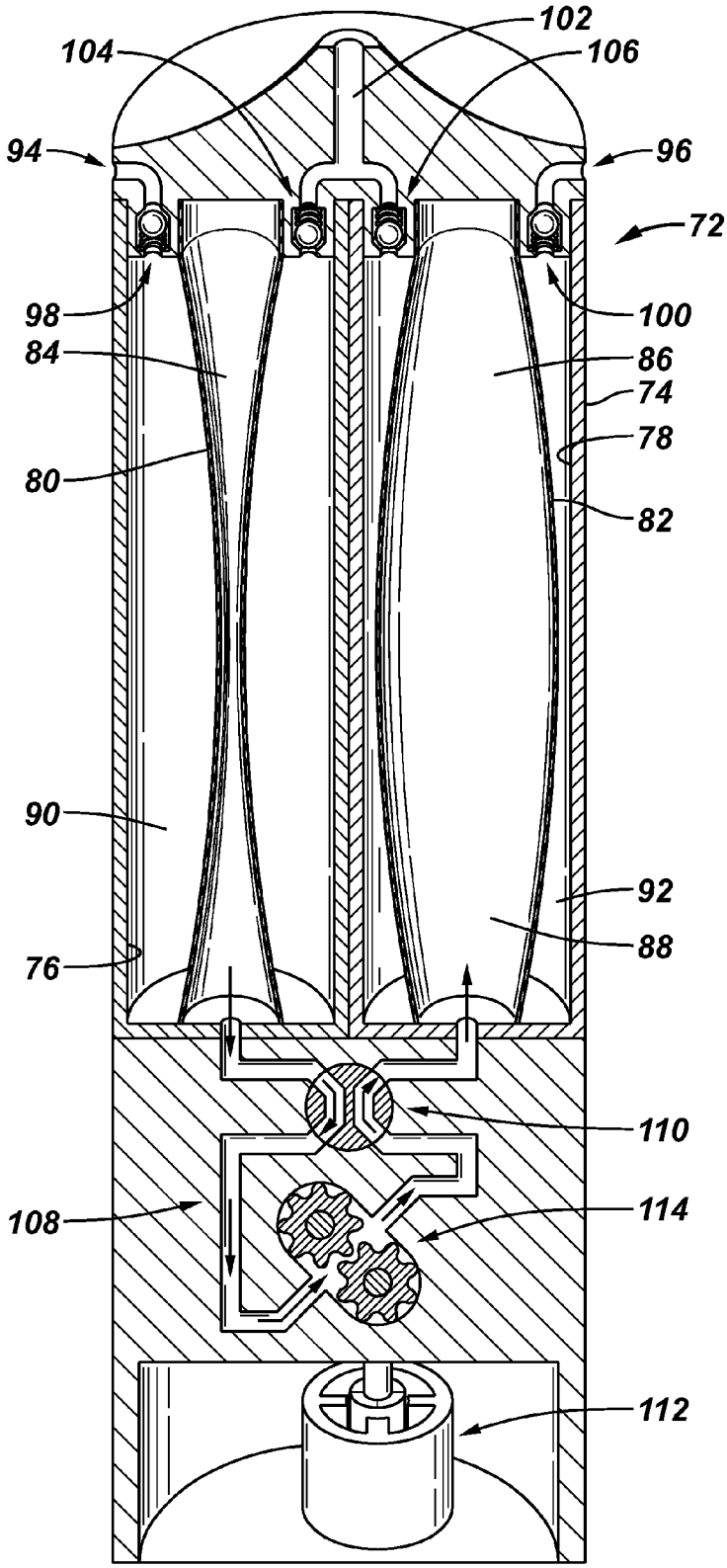
FIG. 5 is view similar to that in FIG. 2 but showing the pump in a different operational state, according to an embodiment of the present invention.
Figure 6:
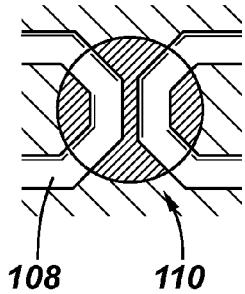
FIG. 6 is an enlarged view of a portion of the pump illustrated in FIG. 5, according to an embodiment of the present invention.

Operation of one embodiment of the pumping system and pumping unit 72 can be described with reference to FIGS. 3-6. As illustrated in FIG. 3, prime mover 112 is operated to drive pump 114 which moves the working fluid into working fluid sub-chamber 84 to expand the expandable member, e.g. diaphragm 80, as the working fluid is removed from working fluid sub-chamber 86 to contract the other expandable member, e.g. diaphragm 82. This action causes well fluid to be drawn into pumped fluid sub-chamber 92 via fluid inlet 96 (see FIG. 4) as expandable member 82 contracts. Simultaneously, the expansion of expandable member 80 imparts energy to any well fluid within pumped fluid sub-chamber 90, and effectively energizes or pumps the well fluid out of pumped fluid sub-chamber 90 via outlet 102.

When expandable member 80 is expanded to a predetermined level, the actuator actuates control valve 110 to a second position to shift the direction the working fluid 88 is pumped through the hydraulic network 108, effectively reciprocating the working fluid. In this second state, pump 114 pumps the working fluid into working fluid sub-chamber 86 to expand expandable member 82 and simultaneously withdraws the working fluid from working fluid sub-chamber 84 to contract the expandable member 80. This reciprocation of working fluid causes the well fluid to be drawn into pumped fluid sub-chamber 90 via fluid inlet 94 as expandable member 80 contracts. Simultaneously, the expansion of expandable member 82 imparts energy to any well fluid within pumped fluid sub-chamber 92, thereby pumping the well fluid out of pumped fluid sub-chamber 92 via outlet 102.

Figure 7:
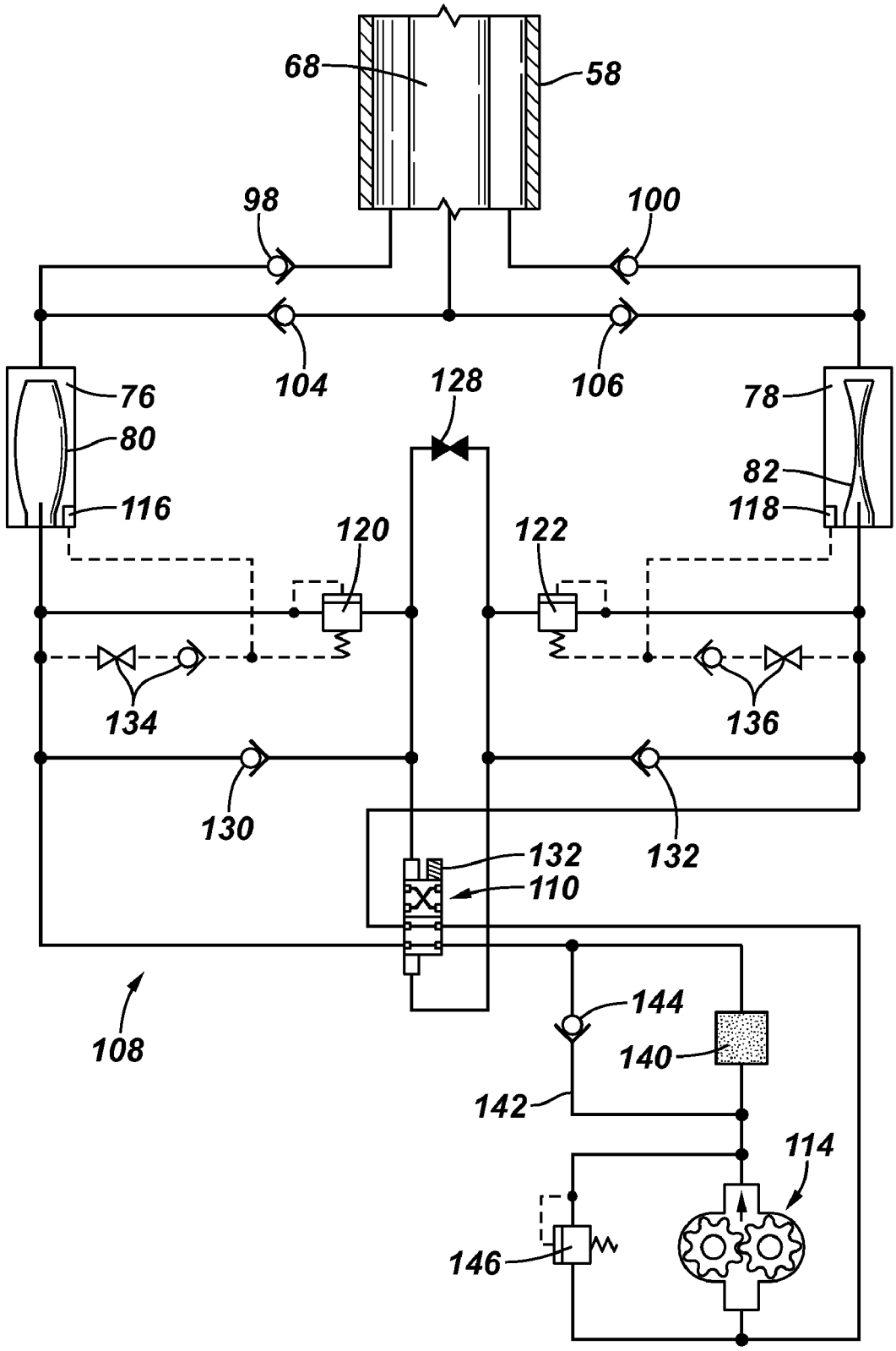
FIG. 7 is a schematic illustration of a pumping system, according to an embodiment of the present invention.

In the embodiment of FIG. 7, a portion of the well completion pumping system 52 is illustrated. This embodiment is designed to employ a pressure differential created between the working fluid 88 and the produced well fluid to change the state/position of the control valve 110. Pump chambers 76 and 78 have corresponding reference chambers 116 and 118 which convey the pressure of the pumped well fluid (or tubing pressure) to corresponding sequencing valves 120 and 122. The sequencing valves act to shift control valve 110 when a predetermined pressure differential is sensed between the working fluid pressure and the pumped well fluid pressure. In this embodiment, control valve 110 may be in the form of a spool valve. The pressure differential occurs as working fluid within a specific working fluid sub-chamber 84 or 86 expands the diaphragm to a predetermined point where any further attempt to expand the diaphragm results in a more rapid pressure increase, i.e. a pressure spike. This rapid increase in pressure differential is sensed by the corresponding sequencing valve which pilots the control valve 110 to shift operating states. The working fluid is then directed away from the expanded diaphragm, e.g. diaphragm 80, and toward the contracted diaphragm, e.g. diaphragm 82. It should be noted that the illustrated pump 114 is driven by an appropriate motive unit 112, even if the motive unit is not illustrated for the description of this embodiment or other embodiments described herein.

The actual shifting of control valve 110 is accomplished by pressure applied selectively via sequencing valves 120 and 122 at two pilot ports 124 and 126 of control valve 110. In this embodiment, pilot ports 124 and 126 are connected together by an orifice 128, and pressure at these ports is relieved by corresponding check valves 130, 132 which connect each port to the respective diaphragm 80, 82. Additionally, the working fluid hydraulic circuit 108 can further comprise appropriate valves 134, 136 with choking functions designed to relieve excess pressure build up due to leakage of the sequencing valves, thus avoiding premature shifting of the control valve 110. Alternatively or in addition, the control valve 110 may comprise a spring device 138 to ensure complete switching of the control valve between operating positions. By way of example, the spring device 138 may comprise a detent latch having appropriate recesses positioned to interact with a spring-loaded ball that holds the control valve 110 at its desired position upon switching.

The working fluid hydraulic circuit 108 also may utilize other features, as illustrated. For example, working fluid pump 114 may be connected to control valve 110 across a filter 140. Additionally, a bypass circuit 142 having a check valve 144 can be connected across filter 140 to protect the flow of working fluid in the event the filter is plugged. Check valve 144 is retained positively closed during regular operation, but upon buildup of pressure due to filter plugging, the check valve 144 opens an alternate flow path along bypass circuit 142. Furthermore, a pressure relief valve 146 can be connected across pump 114 to protect the system against undue pressure build up in the event of a failure or blockage that restricts the flow lines.

Figure 8:
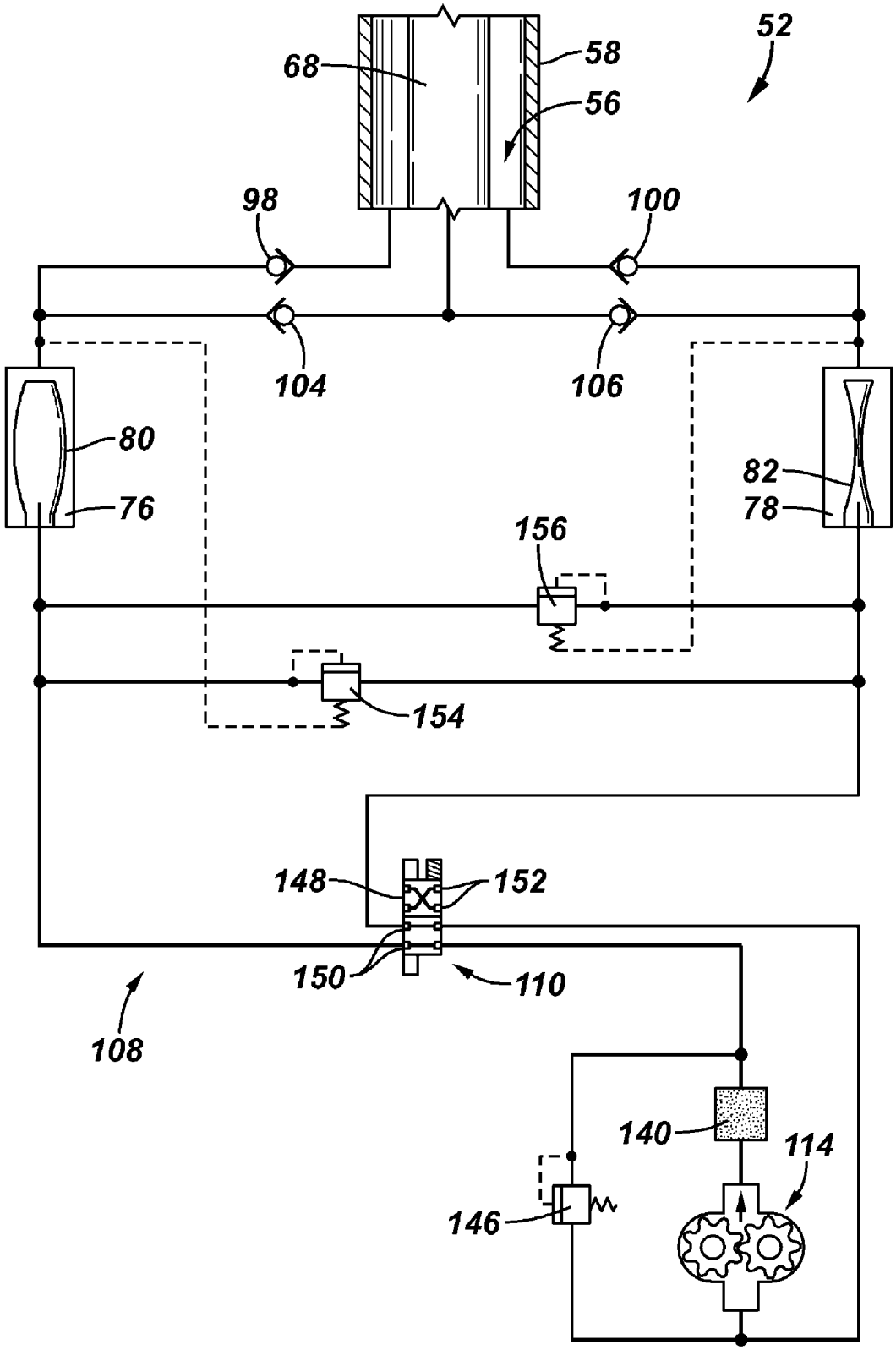
FIG. 8 is a schematic illustration of a pumping system, according to another embodiment of the present invention.

Another embodiment of the pumping system 52 is illustrated in FIG. 8. In this embodiment, the control valve 110 comprises a rotary valve 148 which reciprocates, i.e. alternately directs, flow of working fluid 88 between working fluid sub-chamber 84 of expandable member 80 and working fluid sub-chamber 86 of expandable member 82. The rotary valve 148 comprises a set of ports 150 to direct the flow of working fluid toward working fluid sub-chamber 84 and another set of ports 152 to direct the flow of working fluid to working fluid sub-chamber 86. Although a variety of rotary valves may be used, one example is a valve rotated by a geared down motor shaft which aligns a particular set of ports, 150 or 152, with the working fluid hydraulic network 108 as the valve is rotated. The rotation of the valve switches the flow direction of working fluid. In this embodiment, the switching or reciprocation of working fluid flow between, for example, diaphragms 80 and 82 is a function of the motor shaft rotation and is not driven by sensors or sequencing valves monitoring diaphragm proximity or differential pressure. For example, the system may be designed such that during one complete valve rotation, each diaphragm completes one fill and deflate cycle. However, sequencing valves 154, 156 can be positioned in the working fluid hydraulic network 108 to serve as a pressure relief mechanism for the system in the event of operational problems, including intermittent start-up. For instance, if working fluid is directed to expandable member 80 when the pumping system is started, but expandable member 80 is already fully expanded or nearly fully expanded, then the corresponding sequence valve 154 effectively bypasses the expandable member upon reaching a predetermined pressure threshold.

Figure 9:
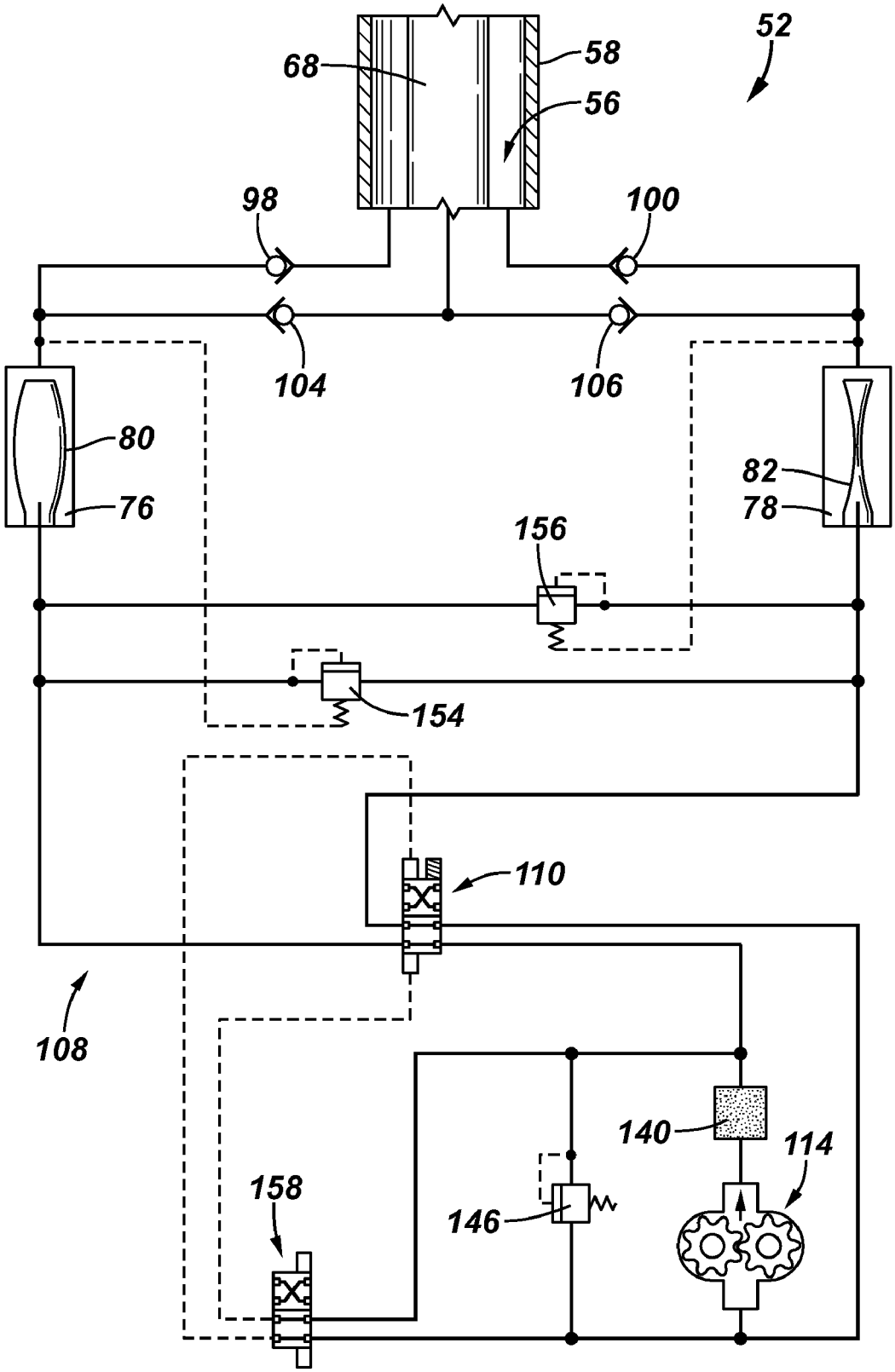
FIG. 9 is a schematic illustration of a pumping system, according to another embodiment of the present invention.

Referring to FIG. 9, another embodiment of well completion pumping system 52 is illustrated. In this embodiment, a pilot valve 158 is coupled to control valve 110. The pilot valve 158 is a rotary valve, and control valve 110 is a spool valve that serves as a two state control valve for directing the flow of working fluid between the working fluid sub-chamber 84 of expandable member 80 and the working fluid sub-chamber 86 of expandable member 82. As illustrated, pilot valve 158 can be actuated to control the application of pilot pressure, supplied by pump 114, to control valve 110 for actuation of the control valve. Thus, rotary valve 158 serves as the mechanism that controls shifting of the main control valve 110.

Figure 10:
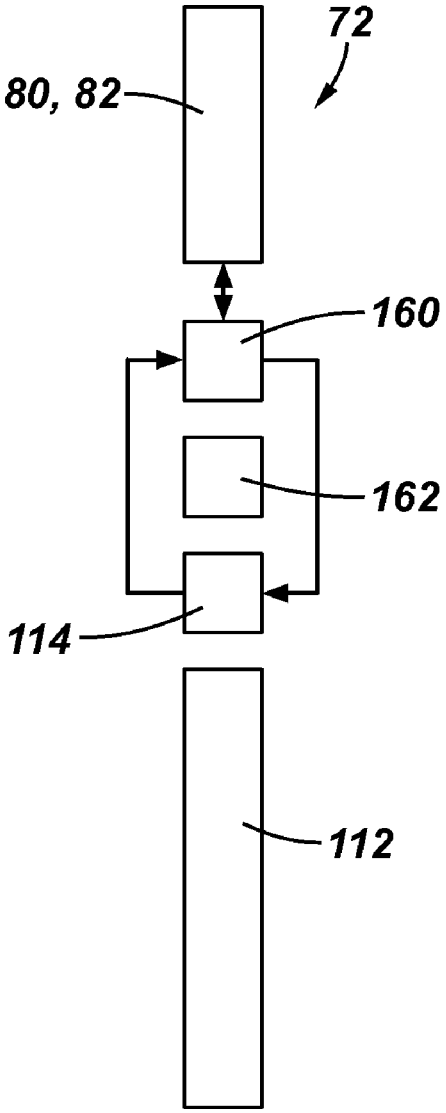
FIG. 10 is a schematic illustration of pump component layout, according to an embodiment of the present invention.

As illustrated in FIGS. 10-13, the use of a rotary valve in an actual submersible pumping unit 72 can be implemented in a variety of configurations. For example, the pumping unit components can be arranged sequentially with the diaphragms 80, 82 coupled to a rotary valve 160 which is coupled to a gearbox 162. The gearbox 162 may be coupled to hydraulic pump 114 which, in turn, is coupled to prime mover 112 in the form of a motor, as illustrated in FIG. 10. In this embodiment, motor 112 powers internal hydraulic pump 114 and rotary valve 160, however the rotational speed applied to the rotary valve is reduced via gearbox 162. The rotary valve 160 serves as a control valve to periodically reverse the flow of working fluid, thereby reciprocating the expansion and contraction of the diaphragms 80, 82.

Figure 11:
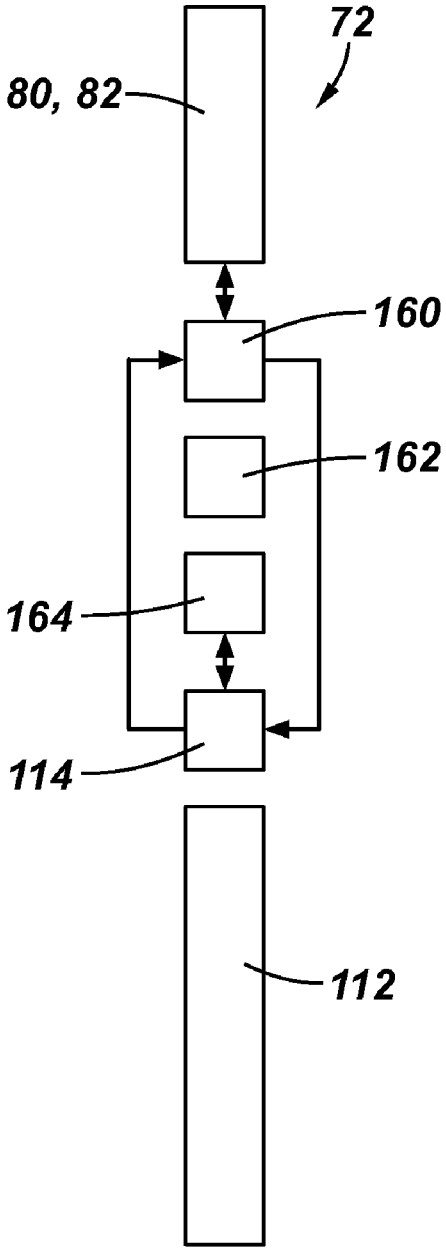
FIG. 11 is a schematic illustration of pump component layout, according to another embodiment of the present invention.
Figure 12:
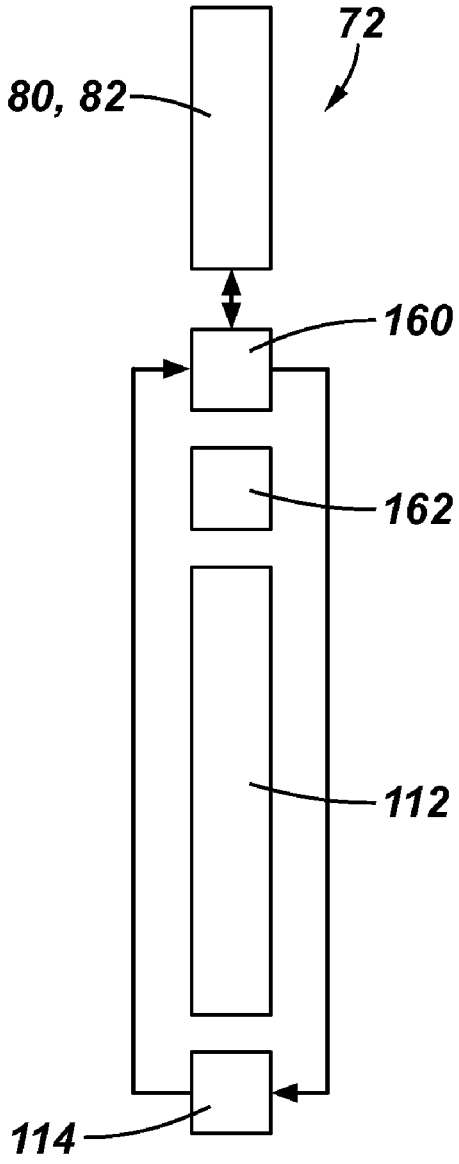
FIG. 12 is a schematic illustration of pump component layout, according to another embodiment of the present invention.
Figure 13:
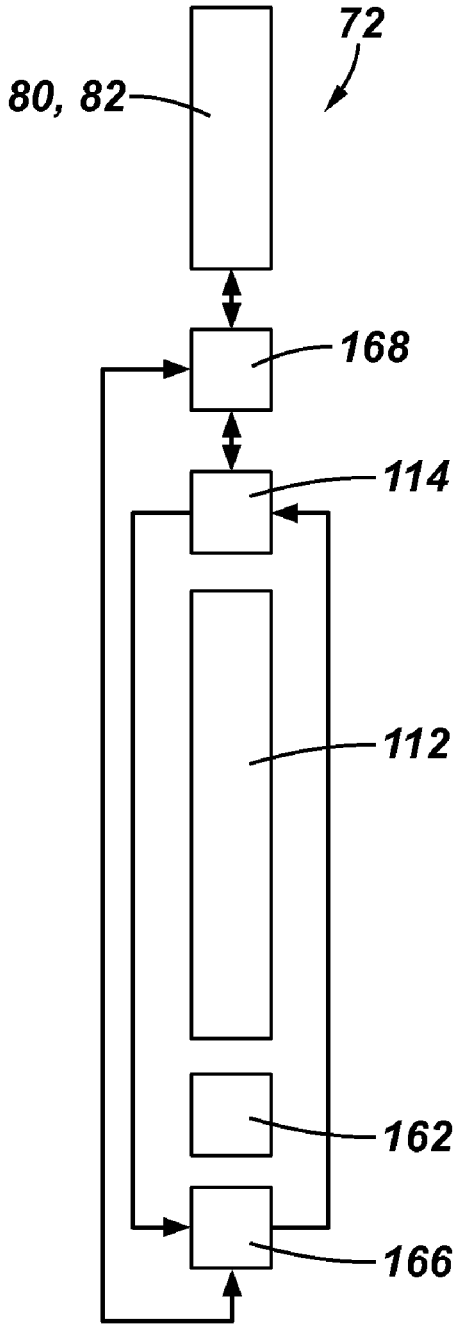
FIG. 13 is a schematic illustration of pump component layout, according to another embodiment of the present invention.

In FIG. 11, an alternate embodiment is illustrated in which a hydraulic motor 164 is positioned between gearbox 162 and internal hydraulic pump 114. The hydraulic motor 164 can be used to rotate rotary valve 160 through gearbox 162 to create the periodic reversal of working fluid flow. In another embodiment, hydraulic pump 114 can be disposed on opposite end of motor 112 relative to gearbox 162, as illustrated in FIG. 12. In this embodiment, motor 112 powers both the internal hydraulic pump 114 and gearbox 162 at its opposed ends. Another configuration utilizes a rotary valve 166 as a pilot valve coupled to a spool valve 168, as previously described with reference to FIG. 9. One physical implementation of this configuration is illustrated in FIG. 13 in which spool valve 168 is located between internal hydraulic pump 114 and diaphragms 80, 82. Motor 112 is positioned on an opposite side of the hydraulic pump 114 from spool valve 168 and is followed by gearbox 162 and rotary valve 166, as illustrated. Hydraulic pump 114 is driven by motor 112 as is the rotary valve 166 via gearbox 162.

Figure 14:
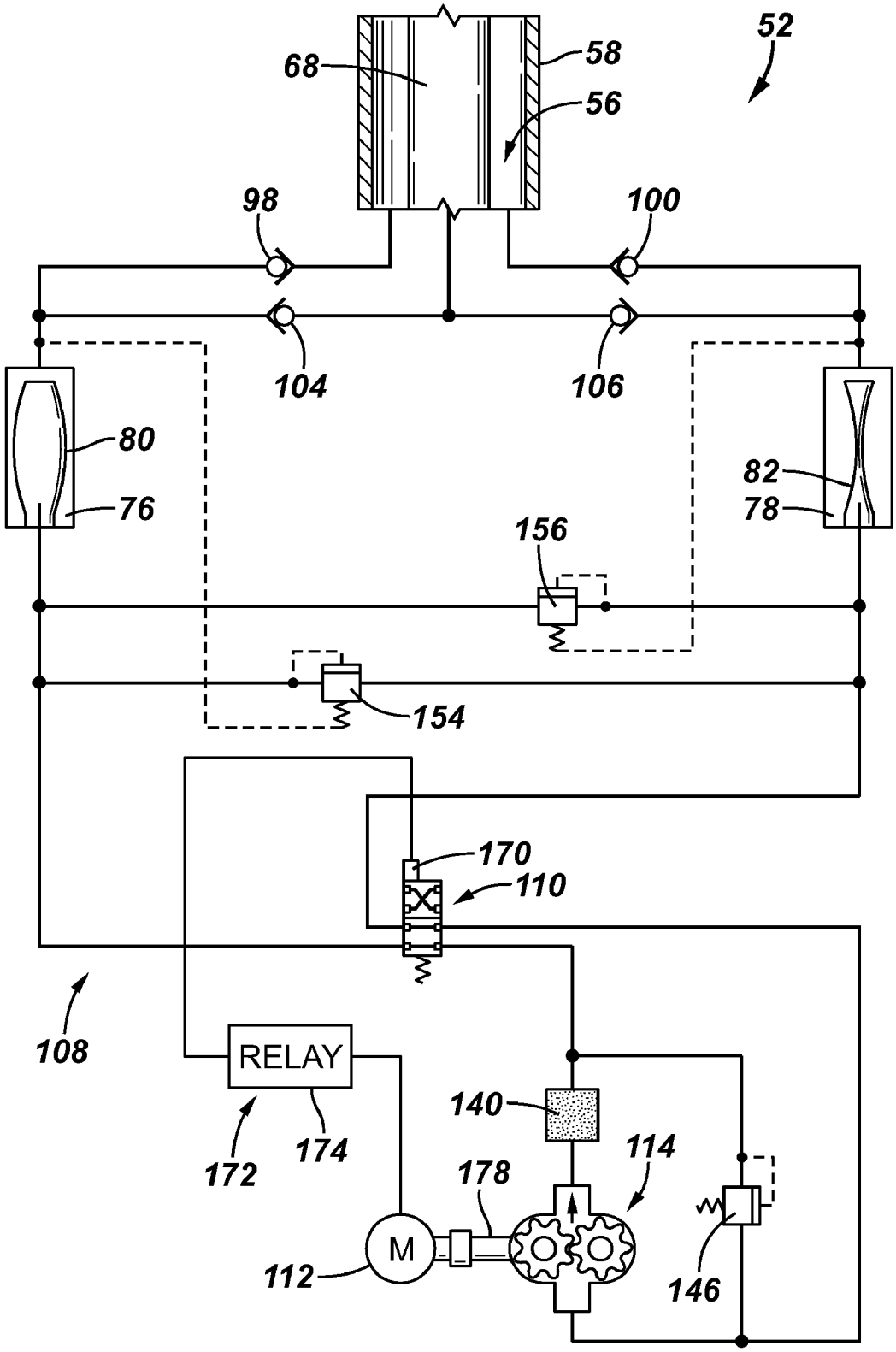
FIG. 14 is a schematic illustration of a pumping system, according to another embodiment of the present invention.

Referring generally to FIG. 14, another embodiment of pumping system 52 is illustrated. In this embodiment, control valve 110 comprises a solenoid actuated control valve 170 to alternately direct flow of working fluid between the working fluid sub-chamber 84 of expandable member 80 and the working fluid sub-chamber 86 of expandable member 82. The flow of working fluid is switched or reciprocated when a predetermined volume of working fluid has been pumped into one of the expandable members, e.g. diaphragm 80 or 82. Accordingly, the volume of pumped working fluid is measured or tracked as each expandable member is filled. According to one method, the volume of working fluid pumped into a given expandable member is inferred from the number of rotations of the motor 112 driving internal pump 114. The rotations of the motor 112 can be tracked by a counter mechanism 172 used to count the rotations of the motor and thus the motor drive shaft that drives internal hydraulic pump 114. Once the predetermined number of rotations has been reached, an electric signal is output by counter mechanism 172 to the solenoid actuated control valve 170. The electric signal actuates the solenoid and shifts the position of the control valve to correspondingly switch the flow direction of the working fluid between expandable members 80 and 82.

One example of counter mechanism 172 comprises an electrical power frequency timer 174. The electrical power frequency timer 174 uses the frequency of the electrical power provided to power motor 112 in determining the rotational speed of the motor 112 and thus rotations of hydraulic pump 114. When pump 114 is, for example, a positive displacement pump, the power frequency may be converted into the working fluid flow rate. With the known volume of an expandable member, e.g. diaphragm volume, a time period can be determined for filling the expandable member. At the end of this time period, an electric signal is sent to the solenoid actuated control valve 170. The electric signal causes actuation of the control valve and consequent switching of the working fluid flow direction from one diaphragm to the other.

The embodiment illustrated in FIG. 14 also can be designed to protect the diaphragms from over expansion due to, for example, intermittent start-up. Sequence valves 154 and 156 can be positioned between the expandable members and the control valve, as described above, to relieve undue pressure. If an expandable member is being pressurized above a selected pressure threshold, the corresponding sequence valve actuates to provide a bypass for the flow of working fluid.

Figure 15:
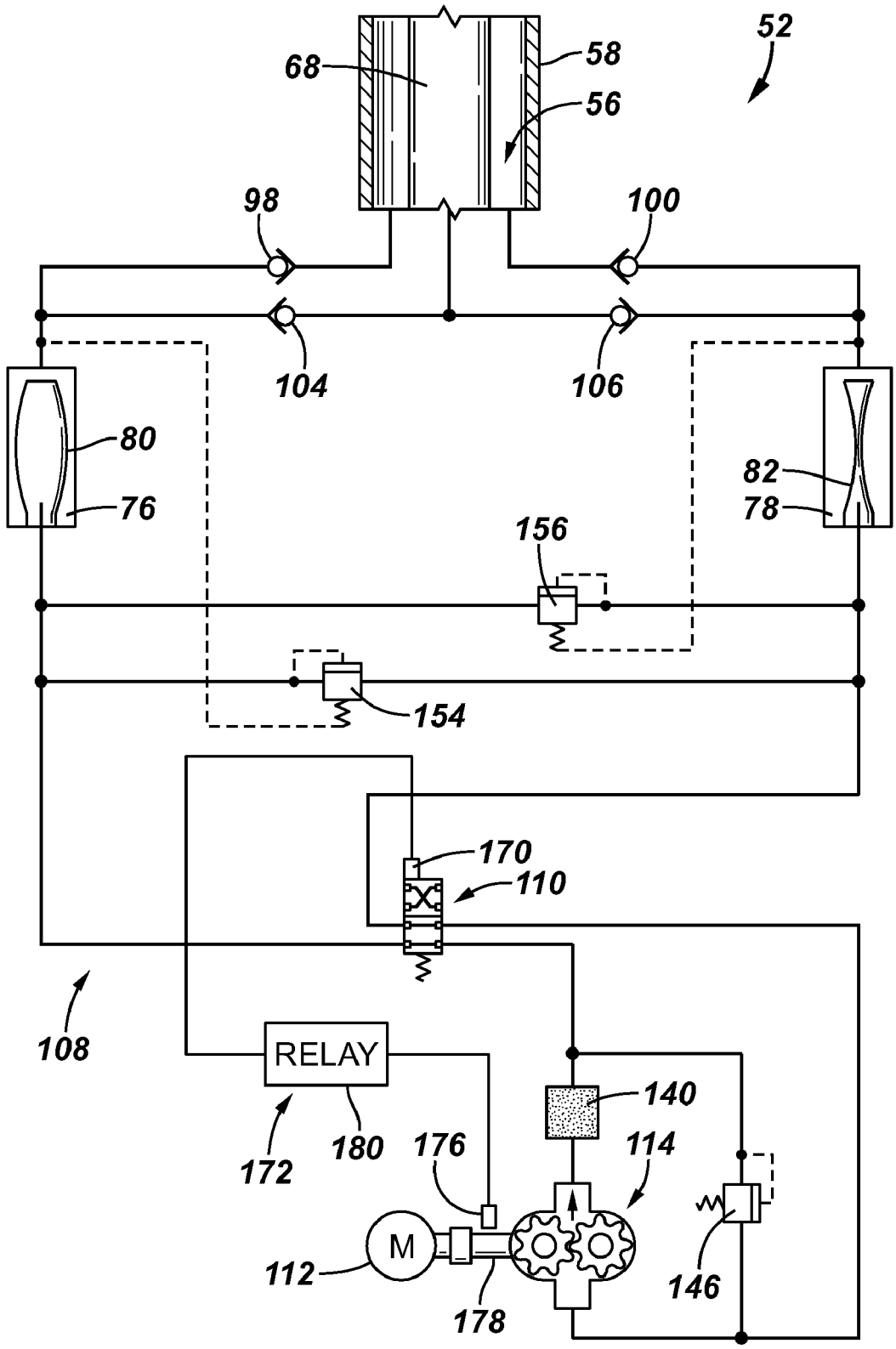
FIG. 15 is a schematic illustration of a pumping system, according to another embodiment of the present invention.

Referring generally to FIG. 15, another embodiment of pumping system completion 52 is illustrated. This embodiment is very similar to that described with respect to FIG. 14, however the counter mechanism 172 comprises a Hall effect sensor 176 position to monitor rotation of a shaft 178 coupling motor 112 to pump 114. The Hall effect sensor 176 outputs a signal to a controller 180 which counts the rotations of the shaft 178 driving hydraulic pump 114. The number of rotations can be used to determine the volume of working fluid that has been pumped by pump 114 into a given expandable member. For example, if pump 114 comprises a positive displacement pump, the volume of working fluid pumped for each rotation is readily determined, and thus the volume of working fluid required to fill a given expandable member can be correlated with a specific number of shaft rotations. When the specific number of shaft rotations is reached, a controller 180 outputs an electric signal to solenoid actuated control valve 170 to actuate the control valve and switch the direction of working fluid flow. It should be noted that other types of sensors also can be used to count the number of shaft rotations.

Figure 16:
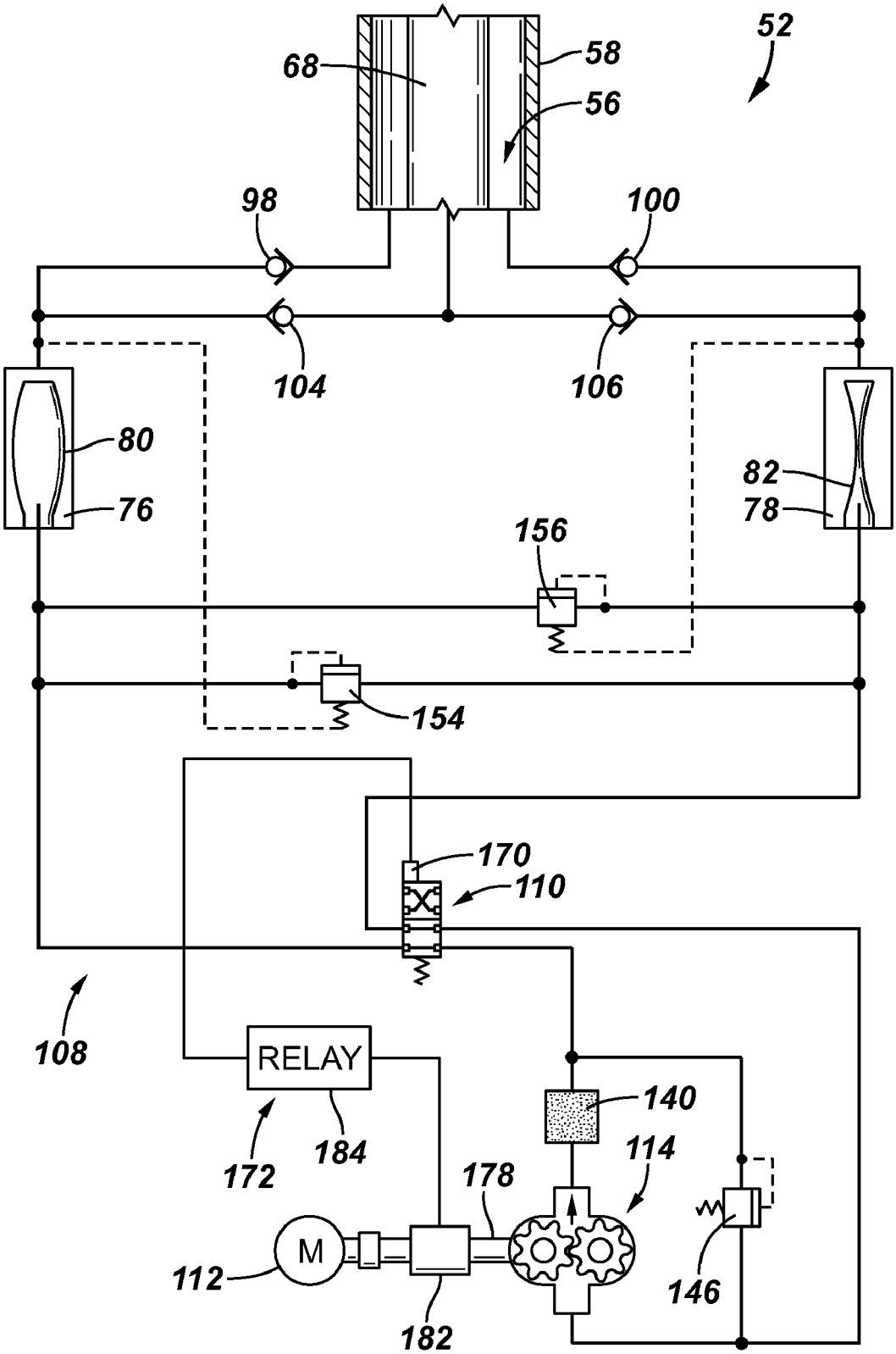
FIG. 16 is a schematic illustration of a pumping system, according to another embodiment of the present invention.

In another embodiment, illustrated in FIG. 16, the counter mechanism 172 comprises an alternator 182 or other electric power generating device. Additionally, counter mechanism 172 comprises an electrical power frequency counter 184. The alternator 182 is installed on the shaft 178 by which motor 112 drives hydraulic pump 114. The electric power frequency generated by alternator 182 may be correlated to the speed of shaft 178, and the rotation of shaft 178 can be correlated with the volume of working fluid pumped by internal pump 114. Accordingly, a time period for filling each expandable device 80, 82 can be calculated, and this time period can be used to provide appropriately timed electric signals to the solenoid actuated control valve 170. The electric signal actuates the control valve and switches the flow direction of the working fluid from one expandable member to another, as described above.

Figure 17:
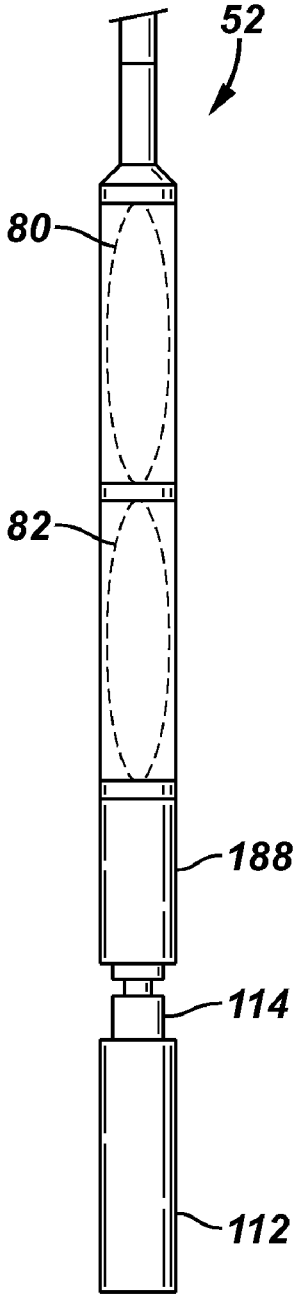
FIG. 17 is a view of a pump having sequential diaphragm chambers, according to an embodiment of the present invention.
Figure 18:
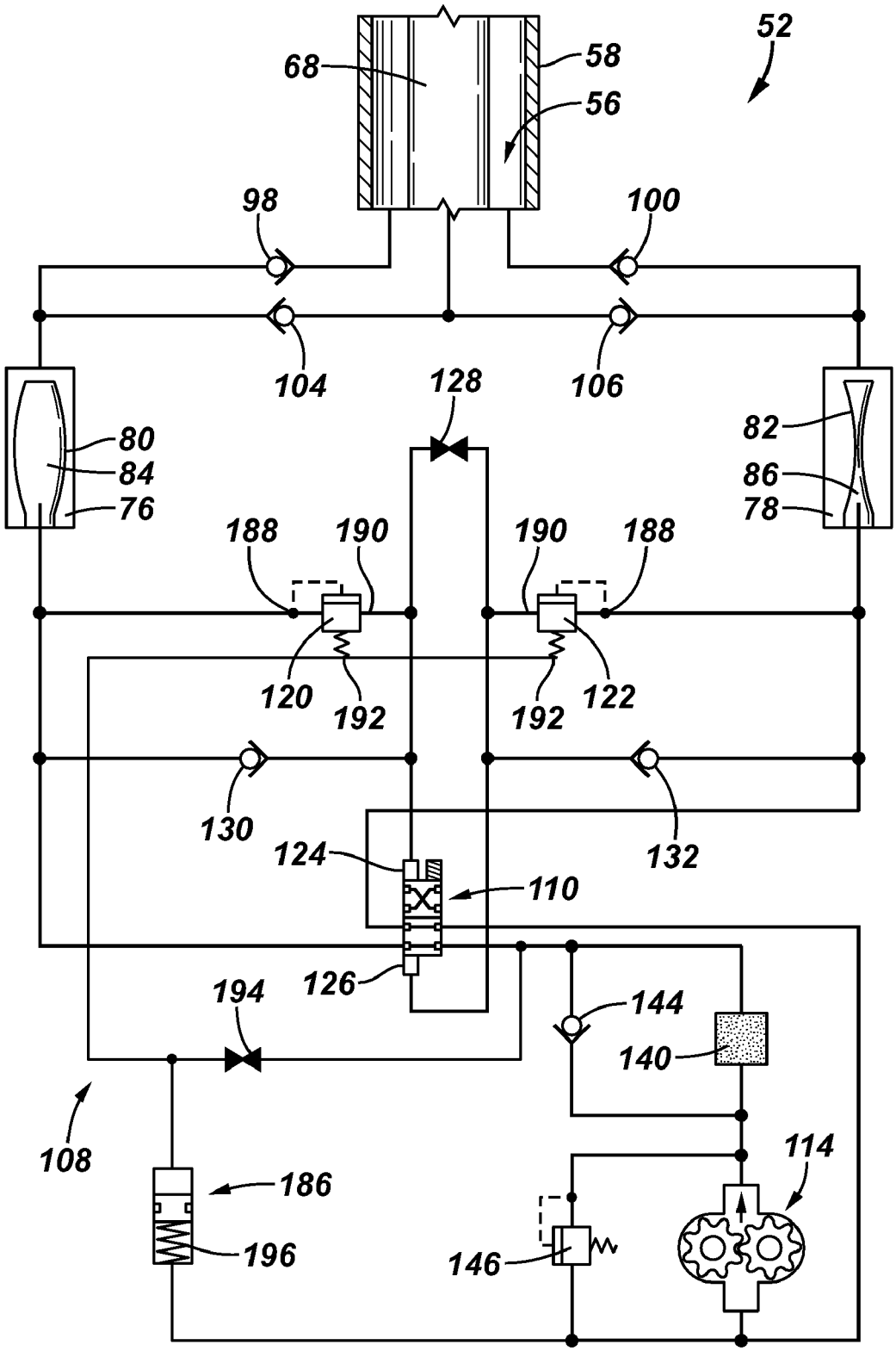
FIG. 18 is a schematic illustration of a pumping system, according to another embodiment of the present invention.

In FIGS. 17 and 18, another embodiment of the pumping system 52 is illustrated. In this embodiment, the control valve 110 is actuated by a pressure differential created between the working fluid sub-chambers 84, 86 and a compensated drain chamber 186. The pressure differential is used to control the reciprocating flow of working fluid between the working fluid sub-chamber 84 of expandable member 80 and the working fluid sub-chamber 86 of expandable member 82. With reference to FIG. 17, an example of component arrangement for this embodiment is illustrated in which the prime mover 112, e.g. an electric motor which receives electrical power from a surface connection, powers hydraulic pump 114. The hydraulic pump 114 provides the hydraulic pressure and flow to diaphragms 80 and 82, and a hydraulic control module 188 contains hydraulic circuitry for controlling the flow of working fluid in and out of the diaphragms 80 and 82. In approximately the first half of a pumping cycle, diaphragm 80 is filled and diaphragm 82 is drained, and in approximately the second half of the pumping cycle, diaphragm 82 is filled and diaphragm 80 is drained.

As illustrated in FIG. 18, working fluid hydraulic network 108 again is designed such that hydraulic pump 114 is coupled to control valve 110 through filter 140. In this embodiment, control valve 110 comprises a spool valve. Again, pressure relief valve 146 may be connected across internal pump 114 to protect the system in case of a failure or blockage restricting the flow lines. Additionally, check valve 144 may be connected across filter element 140 to protect the system against undue pressure buildup due to, for example, plugging of filter 140.

Working fluid 88 is switched between diaphragms 80 and 82 by the spool valve 110. In this example, the spool valve 110 has stable equilibrium positions in each flow direction to minimize chances of uncontrolled actuation. As with the embodiment illustrated in FIG. 7, the position of the spool type control valve 110 is controlled by pilot ports 124 and 126, and pressure to the pilot ports is controlled by sequence valves 120 and 122. Additionally, pilot ports 124 and 126 are connected together via orifice 128. The pressure at the pilot ports can be relieved by check valves 130, 132 coupled to expandable members 80, 82, respectively.

Similar to previous embodiments, expandable members 80, 82 are exposed to well fluid in the surrounding wellbore 56 through check valves 98 and 100. Well fluid is drawn in during contraction of the expandable members and pumped into tubing 68 through corresponding check valves 104, 106 during expansion of the expandable members. The check valves 104, 106 also serve to block any reverse flow of the pumped fluid.

In this embodiment, however, a differential pressure acting on sequence valves 120, 122 is used to actuate control valve 110. Each of the sequence valves 120, 122 includes an inlet port 188, a sequence port 190 and a drain port 192. When the pressure differential between the inlet port 188 and the drain port 192 of a given sequence valves exceeds a preset pressure value, communication is allowed between the inlet port 188 and the sequence port 190. In the embodiment illustrated, the inlet ports 188 of sequence valves 120, 122 are connected to their respective expandable members 80, 82. The drain ports 192 are connected to drain chamber 186 which has a drain chamber pressure regulated to proximity with the pump discharge pressure via an orifice or choke element 194. The orifice or choke element 194 can be connected to either side of the filter 140. Furthermore, the pressure in drain chamber 186 is compensated to the inlet pressure of pump 114 via a spring-biased compensator 196. The compensator 196 serves as a reservoir to fluid drained from a given sequence valve during operation of that particular sequence valve.

Figure 19:
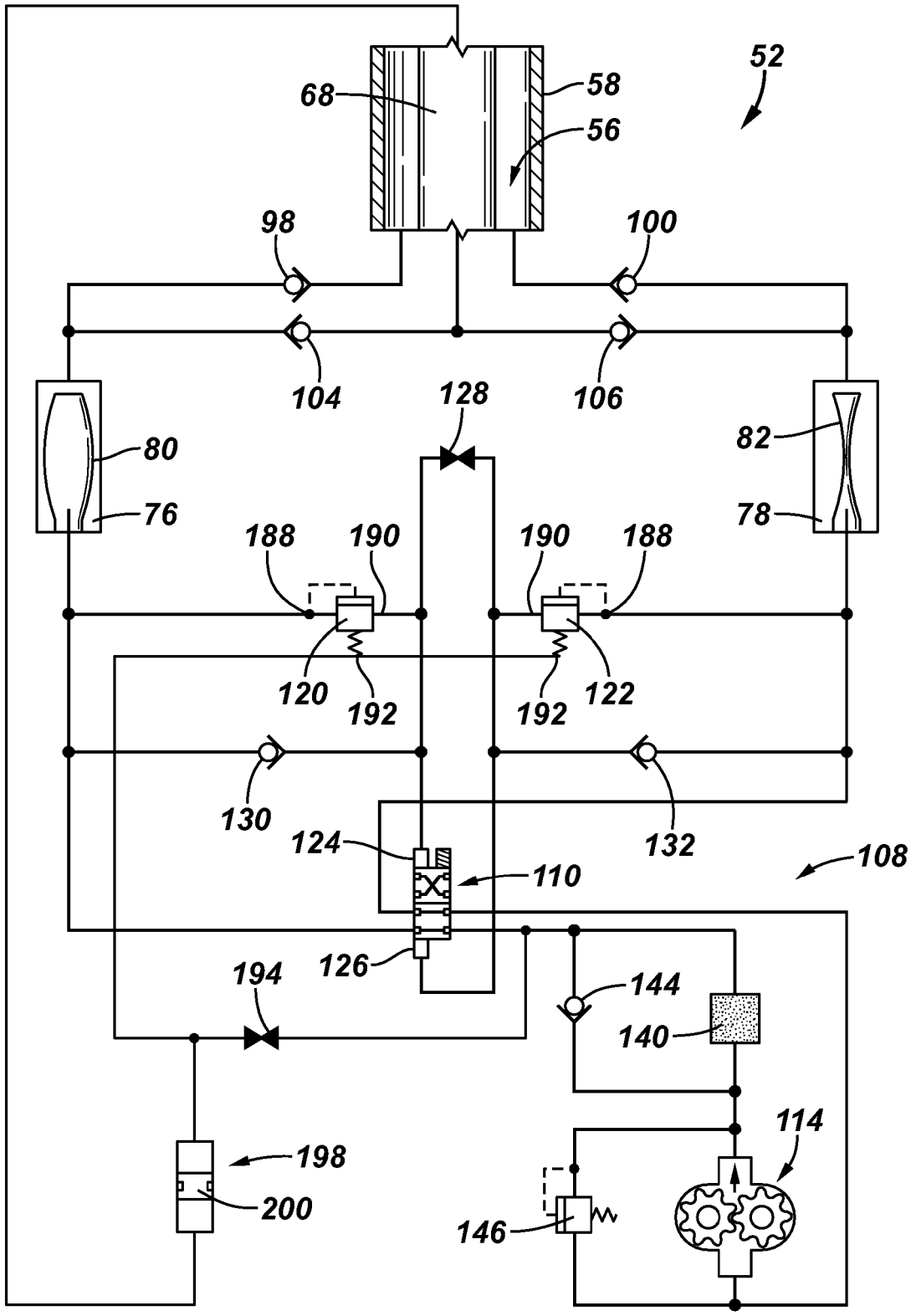
FIG. 19 is a schematic illustration of a pumping system, according to another embodiment of the present invention.
Figure 20:
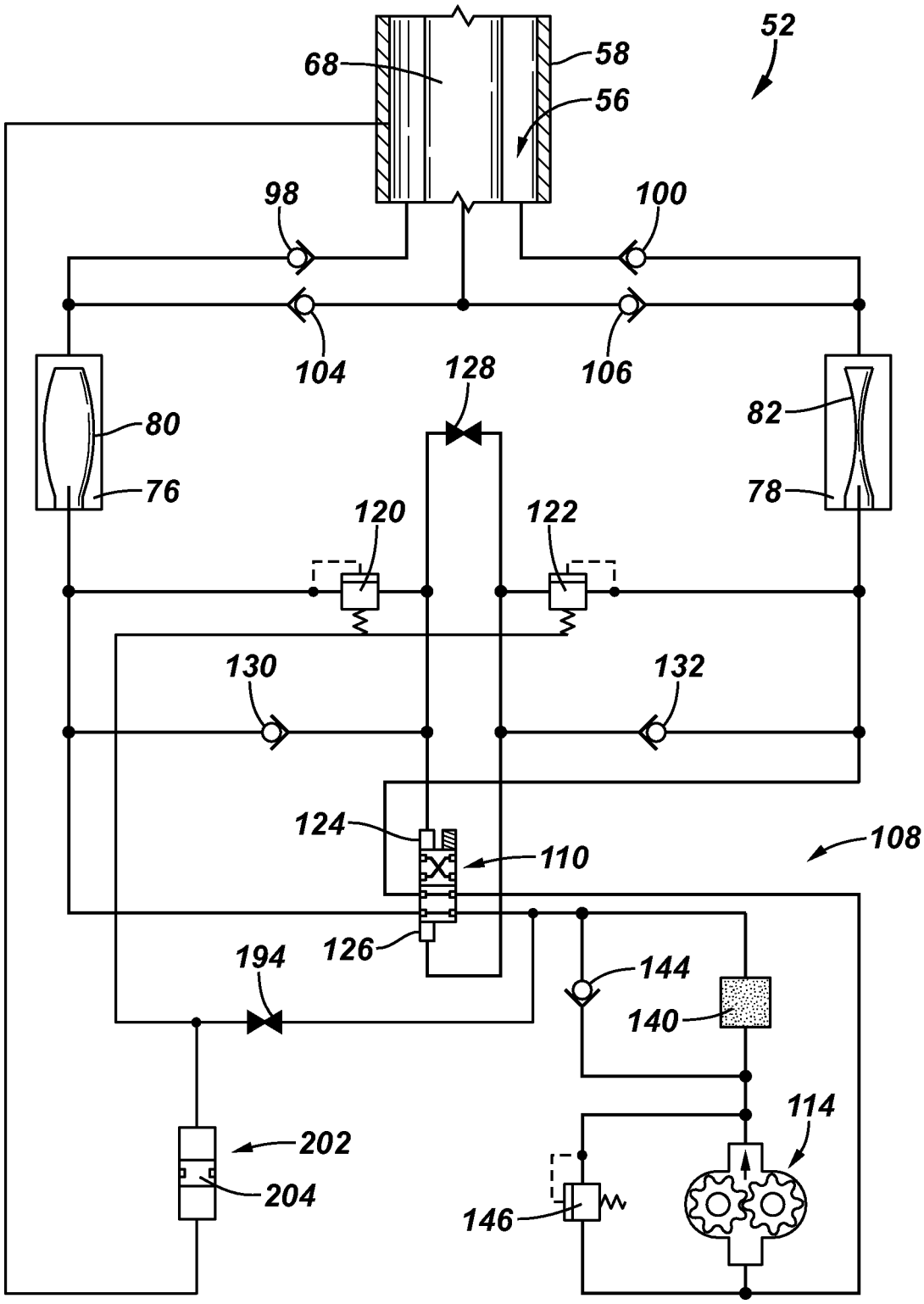
FIG. 20 is a schematic illustration of a pumping system, according to another embodiment of the present invention.
Figure 21:
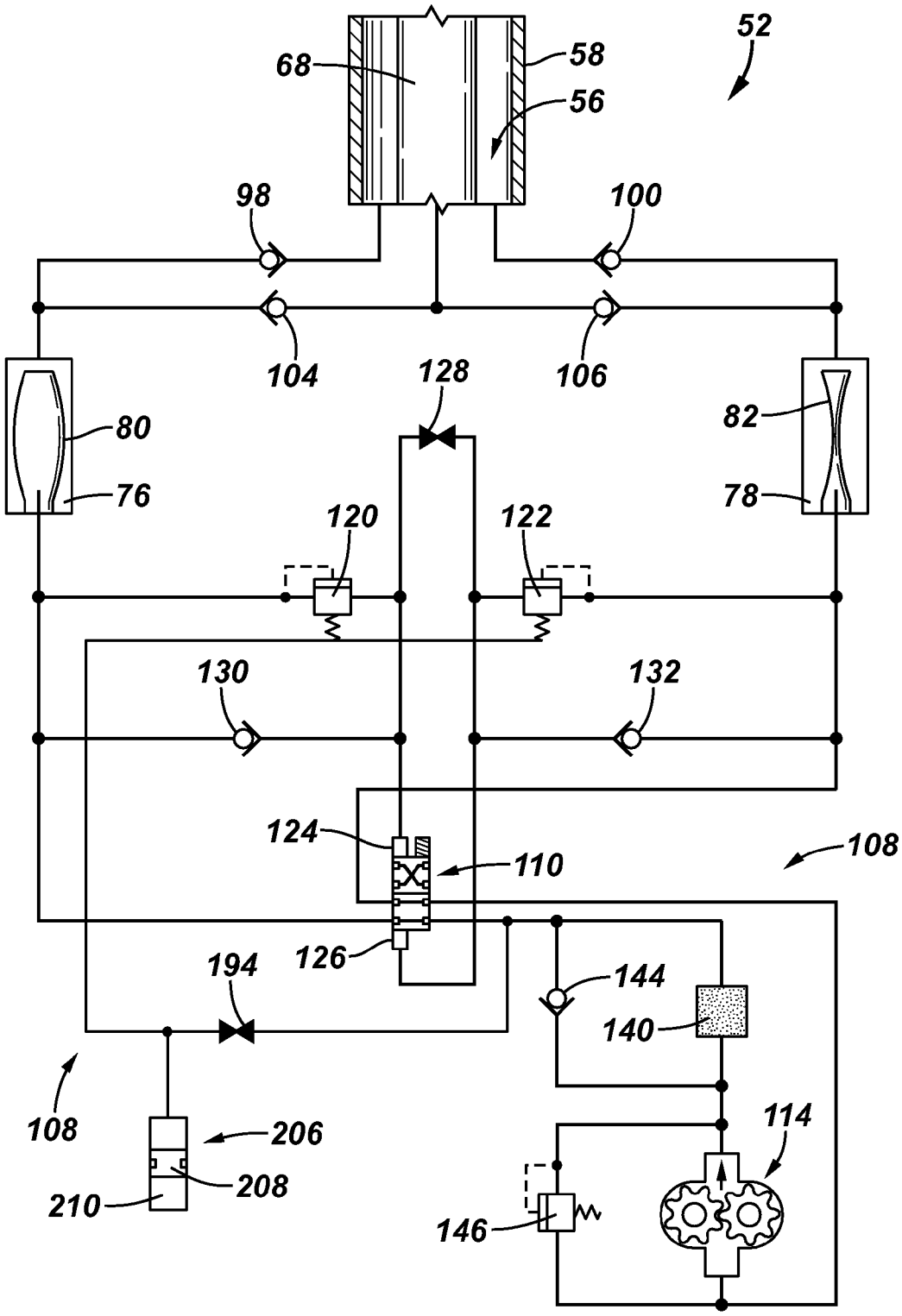
FIG. 21 is a schematic illustration of a pumping system, according to another embodiment of the present invention.

Alternate embodiments utilizing the compensator device are illustrated in FIGS. 19-21. For example, instead of using a drain chamber 186 with spring-biased compensator 196 to allow for drain flow from the sequence valves, the drain flow may be accommodated with a compensated drain chamber 198 having a tubing pressure compensator 200, e.g. a compensator piston, as illustrated in FIG. 19. Tubing pressure compensator 200 is exposed to the pressure of the pumped well fluid in tubing 68. The system also may utilize a compensated drain chamber 202 having an annulus pressure compensator 204, as illustrated in FIG. 20. The annulus pressure compensator 204 is exposed to the pressure of the well fluid in the casing annulus surrounding tubing 68. This type of annulus pressure compensator may also include a spring element as with the spring-biased compensator. Another embodiment utilizes a compensated drain chamber 206 having a sealed compensator 208, as illustrated in FIG. 21. In this embodiment, the working fluid pressure within the compensated drain chamber 206 is compensated to a gas charge, e.g. a nitrogen charge, by the sealed compensator 208, e.g. a piston. The gas charge is contained in a chamber 210 sealed off by compensator 208.

Figure 22:
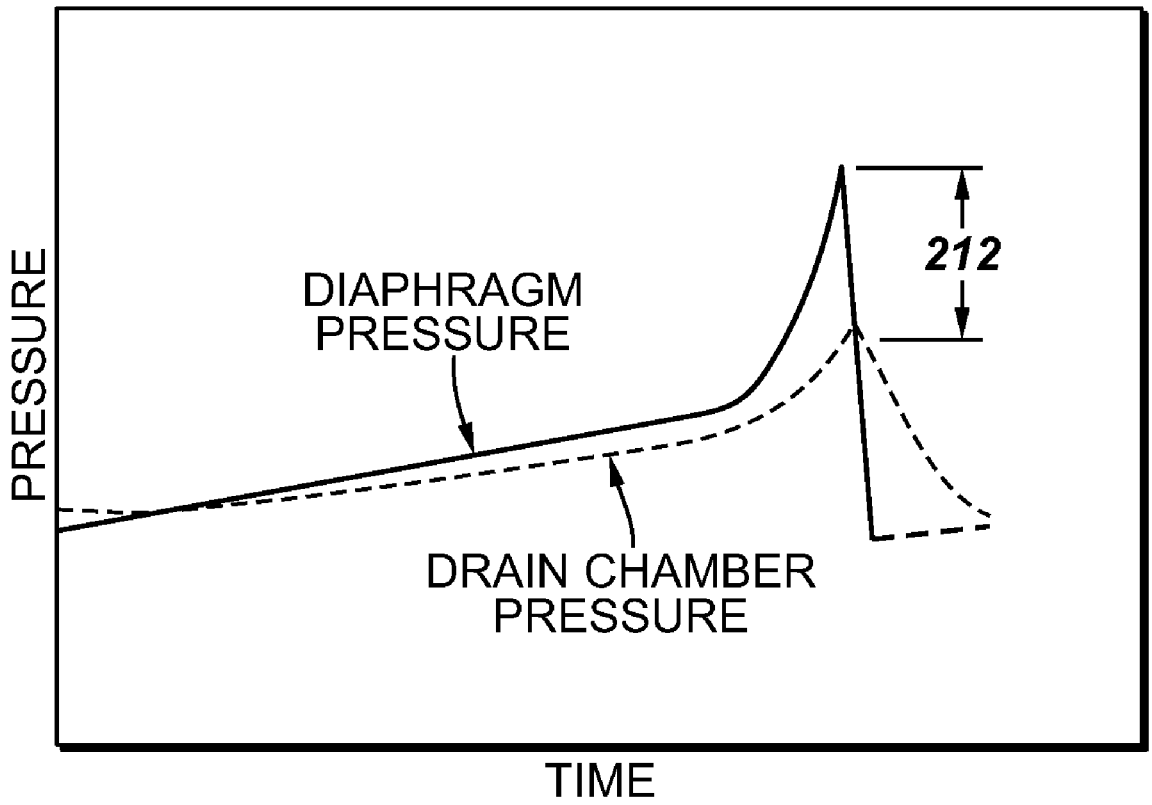
FIG. 22 is a graphical view of pressure plotted against time to illustrate a sequence event by which a sequence valve is actuated to control the reciprocation of working fluid in a pumping system, according to an embodiment of the present invention.

In operation of the pumping system embodiments utilizing a compensated drain chamber, the drain chamber pressure closely follows the expandable member pressure, e.g. diaphragm pressure, during the beginning of a pumping cycle. Communication of the diaphragm pressure with the drain chamber is established through choke 194. As the diaphragm expands and creates contact with surrounding elements, such as the surrounding chamber walls, diaphragm pressure increases at a greater rate, as illustrated in FIG. 22. The orifice or choke element 194 is sized, however, such that the flow to the orifice is not sufficient to follow this greater rate of pressure increase without a significant pressure drop or lag, as illustrated by reference 212 on the graph of FIG. 22. Thus, a pressure differential is created between the diaphragm pressure and the drain chamber pressure. When this pressure differential increases a sufficient amount, the corresponding sequence valve, 120 or 122, is shifted and effectively actuates control valve 110 to its other operating state. This, of course, reverses the flow direction of the working fluid such that the other diaphragm can begin to fill. During filling of the subsequent diaphragm, the drain chamber pressure is again able to substantially equalize with the internal diaphragm pressure of the diaphragm being filled, such that the process can be repeated for the other sequence valve. Use of the compensated drain chamber effectively uses a restriction to working fluid flow to create a time dependent pressure differential used in switching the direction of working fluid flow from one expandable member to the other expandable member.

It should be noted that in some embodiments, the spike in pressure and consequential creation of a differential pressure can be caused by the design or material selection for the expandable members. For example, a stiffer material can be used to create diaphragms. Ultimately, operation of this type of system is based on creating an increased rate of pressure escalation in the expandable members. Because the rate of pressure increase is greatly different before and after the expandable member reaches its limits, e.g. through contact with surrounding components, the system can accurately sense the filling of the expandable members.

Figure 23:
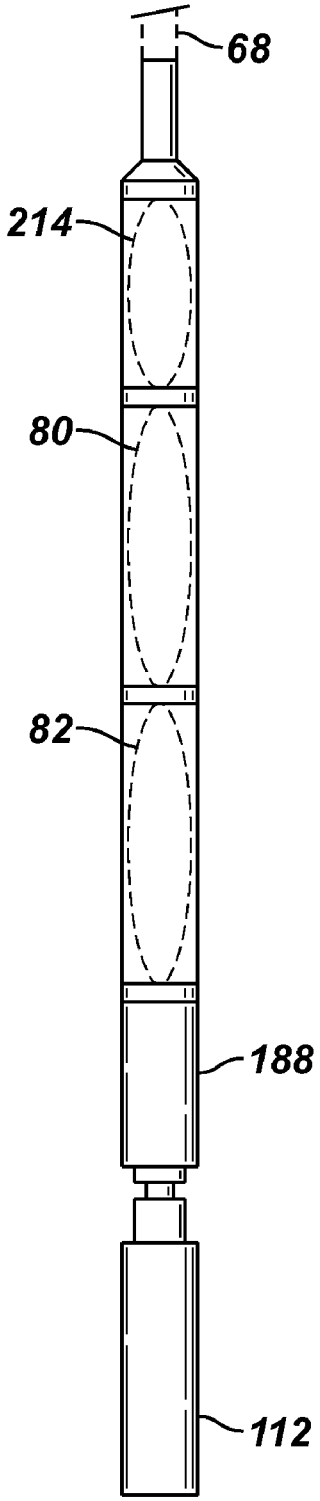
FIG. 23 is a view of a pump having sequential diaphragm chambers and a reference chamber, according to an embodiment of the present invention.
Figure 24:
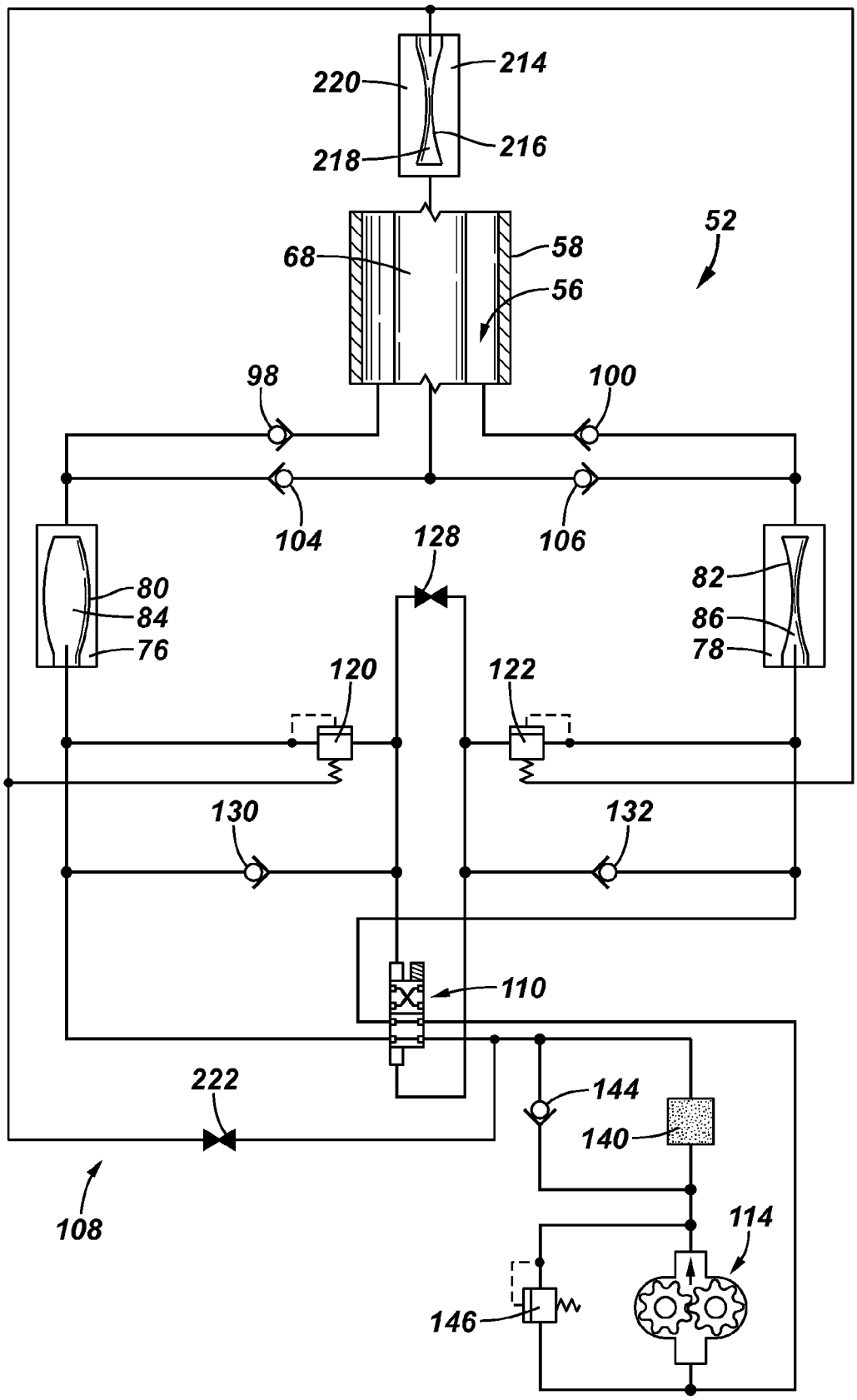
FIG. 24 is a schematic illustration of a pumping system, according to another embodiment of the present invention.

In another embodiment of the pumping system 52, the control valve 110 is actuated by a pressure differential created between the working fluid sub-chambers 84, 86 and a reference chamber, as illustrated in FIGS. 23 and 24. With reference to FIG. 23, an example of component arrangement for this embodiment is illustrated in which the prime mover 112 powers hydraulic pump 114. The hydraulic pump 114 provides the hydraulic pressure and flow to diaphragms 80 and 82, and a hydraulic control module 188 contains hydraulic circuitry for controlling the flow of working fluid in and out of the diaphragms 80 and 82. Additionally, a reference chamber 214 is deployed on an opposite end of diaphragms 80, 82 relative to hydraulic pump 114. In this embodiment, the hydraulic control module 188 contains hydraulic circuitry for sensing tubing pressure changes via reference chamber 214, which is exposed to pumped fluids in production tubing 68.

FIG. 24 illustrates one example of the hydraulic circuitry by which control valve 110 is actuated via creation of a pressure differential between the working fluid sub-chambers 84, 86 and reference chamber 214. The working fluid hydraulic network 108 again is designed such that hydraulic pump 114 is coupled to control valve 110 through filter 140. Also, pressure relief valve 146 may be connected across internal pump 114 to protect the system in case of a failure or blockage restricting the flow lines. Furthermore, check valve 144 may be connected across filter element 140 to protect the system against undue pressure buildup due to, for example, plugging of filter 140.

Flow of working fluid is switched between expandable members 80 and 82 by the control valve 110, e.g. a spool valve. In this example, the control valve 110 has stable equilibrium positions in each flow direction to minimize chances of uncontrolled actuation. As with the embodiment illustrated in FIG. 7, the position of the spool type control valve 110 is controlled by pilot ports 124 and 126, and pressure to the pilot ports is controlled by sequence valves 120 and 122. Additionally, pilot ports 124 and 126 are connected together via orifice 128. The pressure at the pilot ports can be relieved by check valves 130, 132 operatively coupled to expandable members 80, 82, respectively.

Similar to previous embodiments, expandable members 80, 82 are exposed to well fluid in the surrounding wellbore 56 through check valves 98 and 100. Well fluid is drawn in during contraction of the expandable members and pumped into tubing 68 through corresponding check valves 104, 106 during expansion of the expandable members. The check valves 104, 106 also serve to block any reverse flow of the pumped fluid.

In this embodiment, however, the inlet ports 188 of the sequence valves 120, 122 are connected to their corresponding expandable members 80, 82. The drain ports 192 are connected to a sub-diaphragm 216 within reference chamber 214. The reference chamber 214 is subdivided into a working fluid sub-chamber 218 within sub-diaphragm 216 and a pumped fluid chamber 220 external to sub-diaphragm 216 and exposed to the pumped fluid from tubing 68. The reference chamber pressure within the sub-diaphragm 216 is regulated to proximity of pump discharge pressure via an orifice or choke element 222 coupled between sub-diaphragm 216 and pump 114. Because the pump discharge pressure is close to tubing pressure, i.e. the pressure within tubing 68, during operating cycles, the pressure differential created within reference chamber 214 is minimal during regular operation. Again, the orifice or choke element 222 can be connected to either side of the filter element 140.

As the expandable members 80, 82 reach their full state, internal pressure within the filled expandable member rapidly rises and exceeds the tubing pressure acting on sub-diaphragm 216. Accordingly, a pressure differential is created across the corresponding sequence valve, 120 or 122, and the sequence valve is shifted. The shifting of the sequence valve causes a corresponding actuation of the control valve 110, thus shifting the control valve to another operational state for reversing the flow of working fluid and reciprocating the filling of the expandable members.

Some embodiments of the pumping system 52 incorporate reverse direction protection systems. Such protection systems are designed to protect the hydraulic system against inadvertent reversing of flow. Generally, the flow of hydraulic working fluid is in a single direction. If the flow direction inadvertently reverses, the hydraulic logic in some embodiments may be inadequate. When the inadvertent reversal occurs, one of the diaphragms can fill completely and send a signal to switch the control valve. Because the flow direction has been inadvertently reversed, however, the switching signal sent to the pilot port of the control valve attempts to shift the control valve to its current state and not to an opposite state. The working fluid then continues to be supplied to the same diaphragm. Continued supply of working fluid to the filled diaphragm potentially creates damage, including diaphragm or diaphragm housing ruptures, motor housing or thrust bearing damage, internal pump damage, motor overloads and/or other mechanical failures. The potential for "reverse" operation of the hydraulic network exists due to, for example, the possibility of incorrectly or inadvertently reversing the phase relationship of a three-phase motor used as the motive unit. When the phase relationship is altered, the flow direction of the internal pump can be reversed which leads to the reverse flow conditions described.

Figure 25:
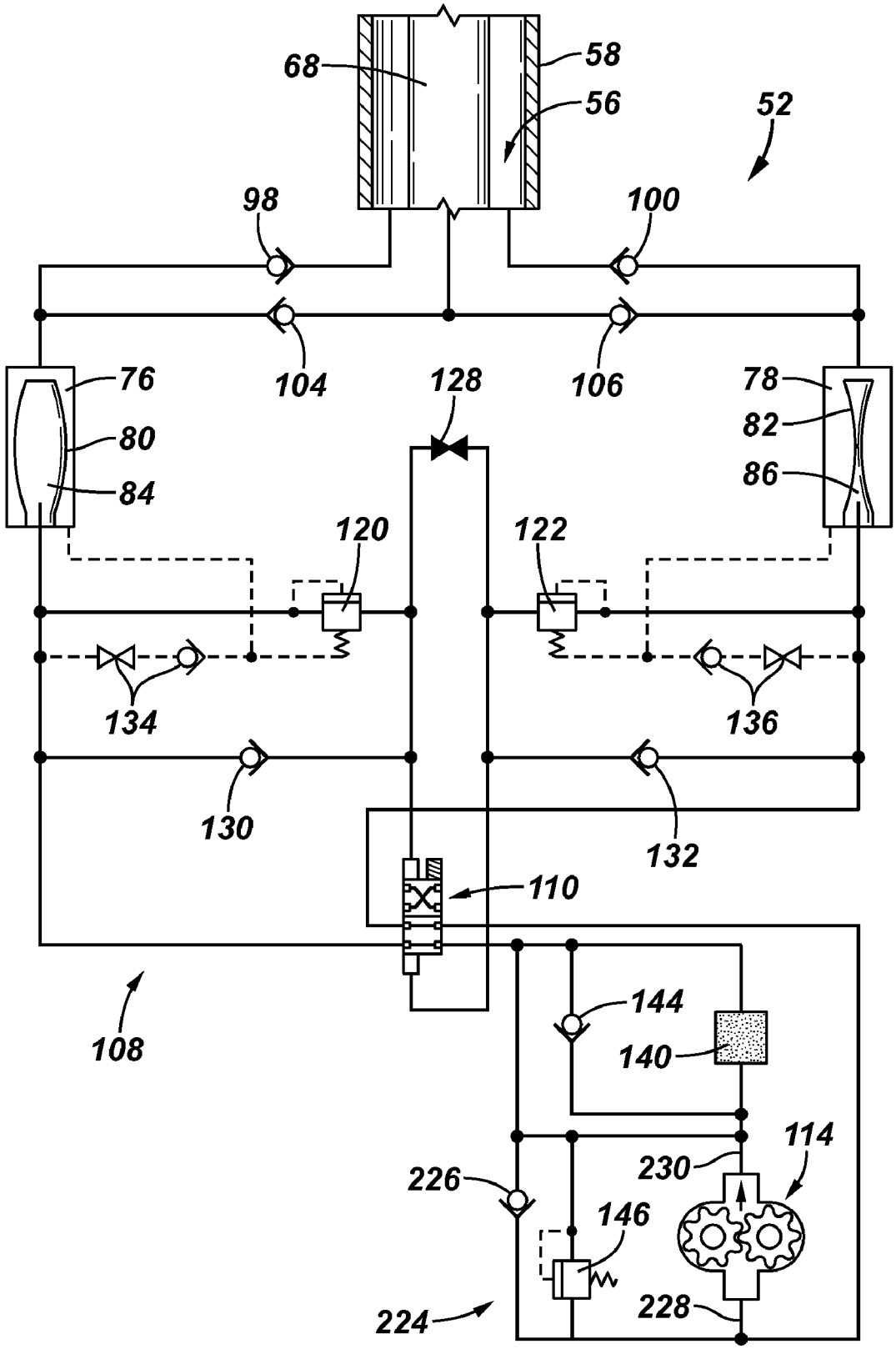
FIG. 25 is a schematic illustration of a pumping system, according to another embodiment of the present invention.

One embodiment of a reverse flow protection system 224 is illustrated in FIG. 25. The reverse flow protection system 224 comprises a free-flowing check valve 226 which is hydraulically connected between a suction side 228 of the positive displacement pump 114 and a discharge side 230 of pump 114. The free-flowing check valve 226 may be coupled into the working fluid hydraulic network 108 on an opposite side of filter 140 from discharge side 230 to allow reverse circulating working fluid to flow through the filter. Alternatively, the check valve 226 can be coupled to the discharge side to 30 of internal pump 114 at a location that bypasses the system filter 140.

When the flow of working fluid is moving in a "forward" direction (e.g., the three-phase motor 112 driving internal pump 114 is operating in the "forward" direction), the check valve 226 remains in a closed position. However, when the flow of working fluid is moving in a "reverse" direction (e.g., the three-phase motor 112 driving internal pump 114 is operating in the "reverse" direction), the check valve 226 is forced to an open, free-flow position. This position creates a free-flow path from the suction side 228 of internal pump 114 to the discharge side 230, thereby preventing excessive pressurization of the diaphragm and/or other components of the system. The reverse flow protection system 224 enables operation of the pumping system in reverse direction for a substantial period of time without creating damage.

An operator is readily able to determine the occurrence of reverse operation by a variety of indicators. For example, during reverse operation, well fluids are not produced because the working fluid is passing through check valve 226 and not filling the pumping diaphragms 80, 82. Another indicator may be low current draw by the three-phase motor 112 driving pump 114. The electrical current drawn by the motor is proportional to the differential pressure developed by pump 114, when pump 114 comprises a positive displacement pump. In reverse operation, there is minimal restriction through the free-flowing check valve 226, and therefore the differential pressure developed by pump 114 is low. The result is a lower current draw when the system is in reverse operation compared to the current draw during normal, forward operation. Additionally, the electric current draw is relatively constant, because the system does not "build head" that would otherwise occur due to increased hydrostatic pressure as fluid is produced up through tubing 68. The electric current draw also remains constant, because no current spikes are created that would otherwise occur due to shifting of the directional control valve.

Figure 26:
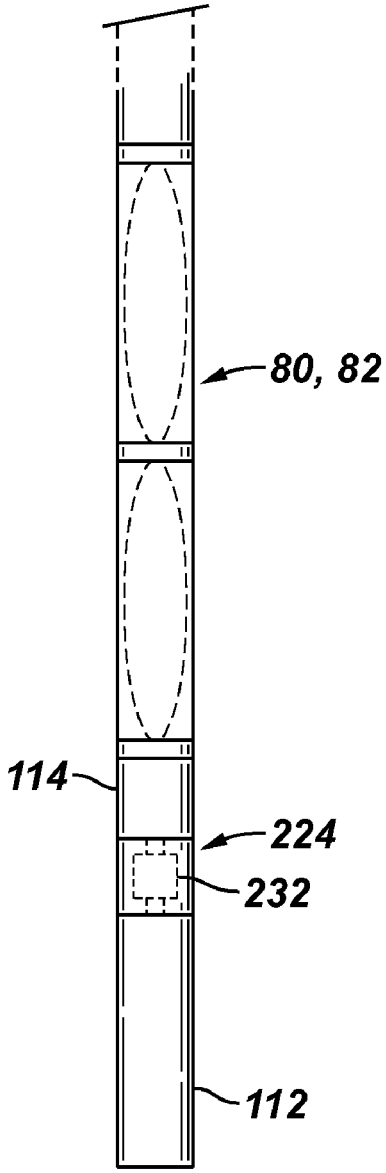
FIG. 26 is a front elevation view of a pump utilizing an overrun coupling, according to an embodiment of the present invention.

Another embodiment of reverse flow protection system 224 is illustrated in FIG. 26. In this embodiment, an "overrunning coupling" or clutch 232 is positioned to replace the shaft between motor 112 and pump 114. By way of example, motor 112 may comprise a three-phase motor, and pump 114 may comprise a positive displacement pump. The overrunning coupling 232 transmits the full torque from motor 112 to pump 114 in the forward direction, but transmits minimal torque in the reverse direction. In other words, the overrunning coupling "slips" when motor 112 operates in the reverse direction. The torque transmitted by motor 112 to pump 114 in the reverse direction should be sufficiently low such that pump 114 cannot excessively pressurize the diaphragms 80, 82 or other system components. This type of reverse flow protection system also enables the system to run for a substantial period of time in the reverse direction without damaging the system. During this time, an operator can determine the state of reverse operation by making observations as discussed above.

Figure 27:
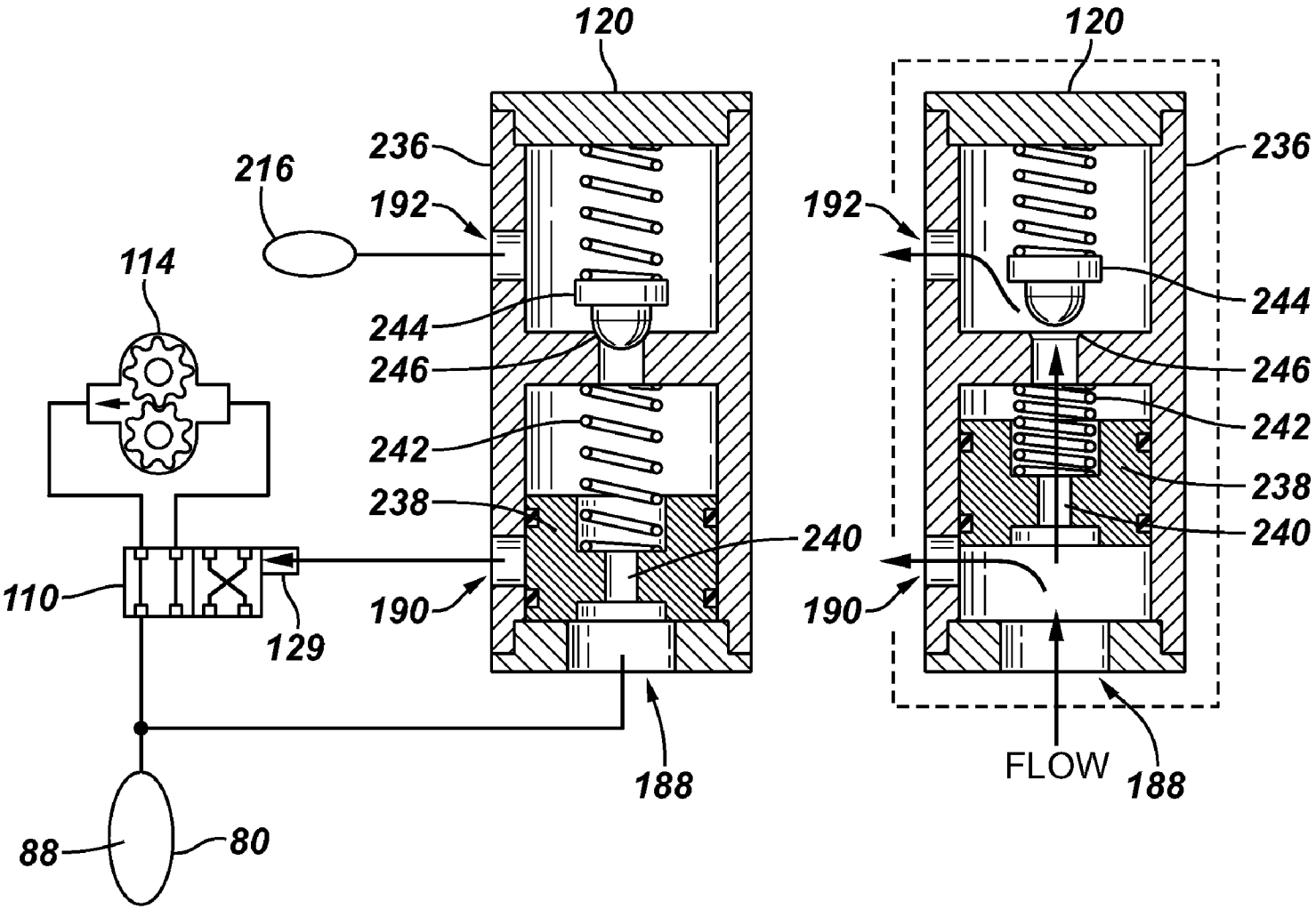
FIG. 27 is a schematic illustration of a portion of a pumping system utilizing a pilot operated sequence valve, according to another embodiment of the present invention.

Many of the embodiments described herein incorporate sequencing valves to provide input to the directional control valve 110. An example of a pilot-operated sequence valve is labeled with reference 120 and illustrated in FIG. 27. As illustrated, inlet port 188 is in fluid communication with an expandable member, such as diaphragm 80. Sequence port 190 is in fluid communication with directional control valve 110 for selective actuation of the control valve, and drain port 192 is in fluid communication with a reference pressure source, such as a sub-diaphragm or control chamber diaphragm 216 located in a reference chamber. In this embodiment, pilot-operated sequence valve 120 comprises an outer housing 236 with a dynamic sealing piston 238 slidably mounted therein. The dynamic sealing piston 238 has an orifice 240 and is biased to block sequence port 190 by a spring member 242. Additionally, fluid flow between orifice 240 and diaphragm 216 is blocked by a spring biased ball 244 biased against a corresponding seat 246.

As the pressure in diaphragm 80 rises above the pressure in the control chamber diaphragm 216, ball 244 is biased away from seat 246 and flow is initiated to the control chamber diaphragm. As the pressure in diaphragm 80 rapidly increases, the ball and seat valve opens further allowing additional flow through orifice 240 of dynamic seal 238. Eventually, the pressure drop generated by the restriction of flow through orifice 240 overcomes the force of spring 242, causing the dynamic sealing piston 238 to slide in the direction of flow, as illustrated by the open valve configuration shown in the dashed box of FIG. 27. This motion opens sequence port 190 and allows the flow of pressurized fluid to the appropriate pilot port on the directional control valve 110, thereby shifting the control valve.

Figure 28:
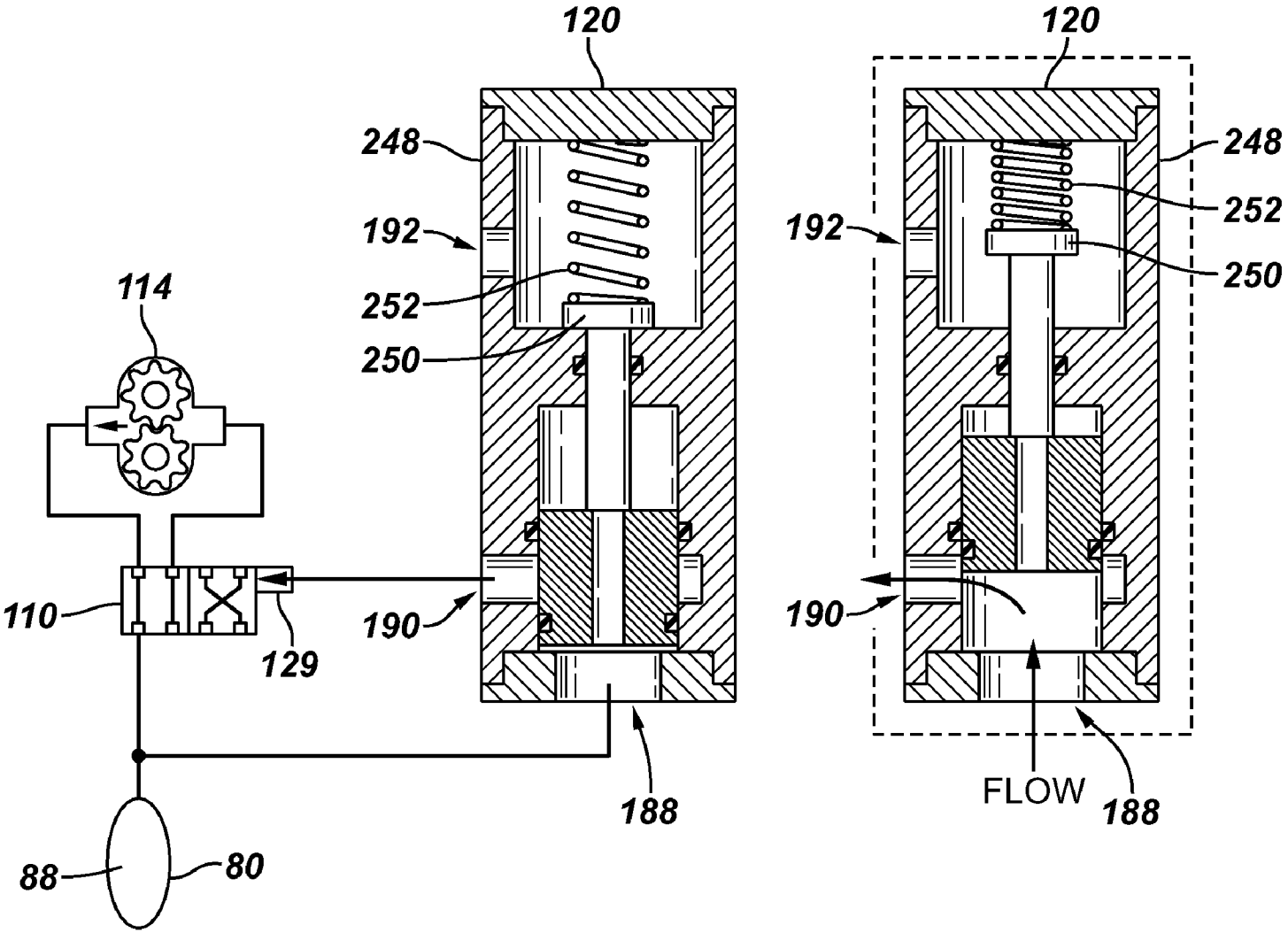
FIG. 28 is a schematic illustration of a portion of a pumping system utilizing a direct acting sequence valve, according to another embodiment of the present invention.

An alternate embodiment of sequence valve 120, 122 is illustrated in FIG. 28. This enhanced embodiment of the sequence valve allows for the removal of control chamber diaphragms from the pumping system, and can be referred to as a direct-acting sequence valve. When the pilot-flow activated sequence valves are replaced with direct-acting sequence valves, the well fluid and hydraulic working fluid are isolated from each other by dynamic seals within each of the direct acting sequence valves. Because the dynamic seal isolates the well fluid from the working fluid, the control chamber diaphragms are not required. This can reduce the complexity of the design, eliminate the risk of rupturing a control chamber diaphragm, and potentially provide faster response, thereby reducing the pressure spike which occurs as expandable member 80, 82 reaches its expansion limit.

An example of a direct-acting sequence valve 120 is illustrated in FIG. 28. As illustrated, inlet port 188 is in fluid communication with an expandable member, such as diaphragm 80. Sequence port 190 is in fluid communication with directional control valve 110 for actuation of the control valve, and drain port 192 is exposed to wellbore fluid and pressure in, for example, tubing 68. In this embodiment, direct-acting sequence valve 120 comprises an outer housing 248 with a dynamic sealing element 250, such as a slidable piston sealingly mounted within housing 248. The dynamic sealing element 250 serves as an interface between the working fluid, acting on ports 188 and 190, and the well fluid acting on drain port 192. The dynamic sealing element 250 is biased by an adjustable spring member 252 against the pressure of the working fluid.

When the differential pressure between the pressure within diaphragm 80 and the pressure of the well fluid acting on drain port 192 rises above the setting of adjustable spring member 252, the dynamic sealing element 250 is moved against spring member 252. This motion of dynamic sealing element 250 directly controls the opening, and subsequent closing, of sequence port 190. The opening of sequence port 190 allows the flow of pressurized fluid to the appropriate pilot port on the directional control valve 110, thereby shifting the control valve. An example of a direct-acting sequence valve 120 in an open position for shifting directional control valve 110 is illustrated within the dashed box of FIG. 28.

In at least some embodiments, the pumping system 52 can be designed with a mechanism for ensuring complete switching of control valve 110. As discussed above, control valve 110 may comprise a directional control valve having two operating states that determine the direction of flow into and out of the expandable members 80, 82. Some directional control valve designs also effectively have a third momentarily closed position. The directional control valve passes through this momentarily closed position as it switches between operating states. If, for example, the control valve switches between states during start-up or shut-down of the pumping system, the directional control valve can stop in this momentarily closed position. However, a mechanism, such as a spring device, can be added to the control valve to render the momentarily closed position unstable. In other words, the mechanism ensures shifting of the control valve to one of its operating states.

Figure 29:
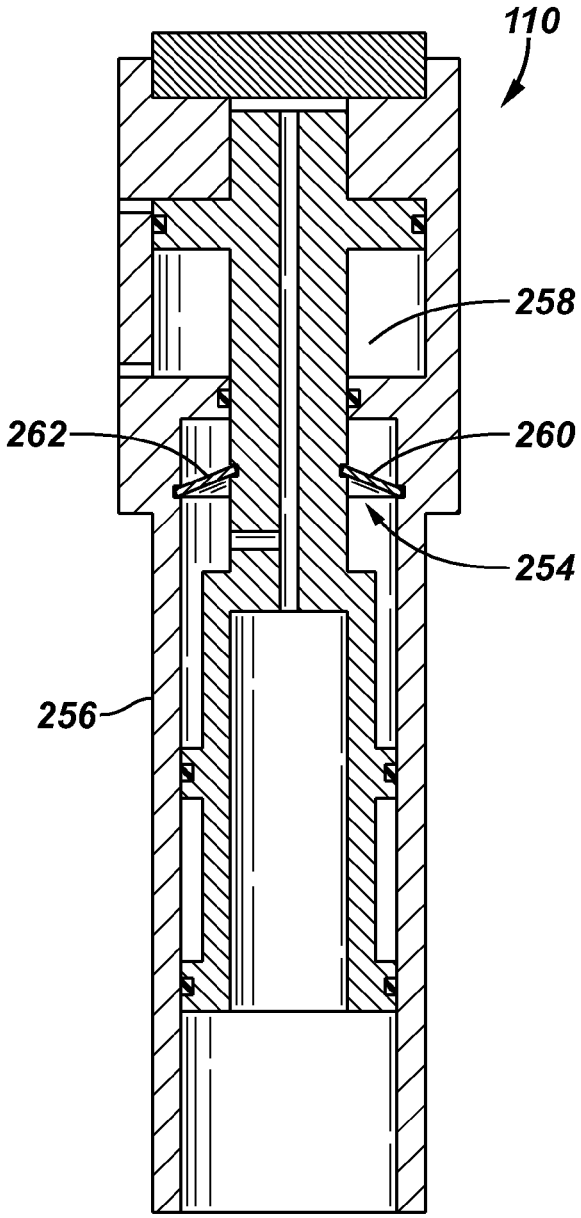
FIG. 29 is a cross-sectional view of a control valve having a spring mechanism to ensure complete switching of the control valve between operating positions, according to an embodiment of the present invention.
Figure 30:
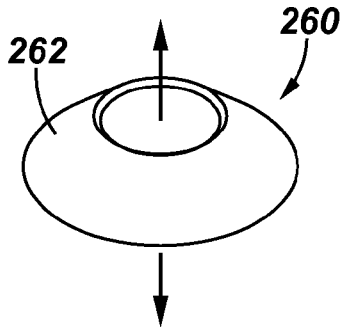
FIG. 30 is an orthogonal view of a conical spring that can be used with the spring mechanism illustrated in FIG. 29, according to an embodiment of the present invention.

Referring generally to FIGS. 29 and 30, one embodiment of a mechanism 254 for ensuring complete switching of control valve 110 is illustrated. In this embodiment, control valve 110 comprises a spool-type control valve having a valve body 256 and a shuttling piston 258 slidably mounted within the valve body 256 for movement between the two operational states. Mechanism 254 comprises a spring device 260 connected between shuttling piston 258 and valve body 256. The force applied to the shuttling piston by spring device 260 varies depending on the position of the shuttling piston, but the spring device 260 ensures that control valve 110 is not stable in the momentarily closed position. Spring device 260 is designed to exhibit "snap through" behavior. One specific example of spring device 260 comprises one or more conical springs 262 (see FIG. 30). As the conical spring 262 is compressed beyond a flattened state during movement of shuttling piston 258, the direction of force applied to the shuttling piston by the conical spring rapidly reverses, and the control valve is forced past the momentarily closed position toward the next operational state.

Figure 31:
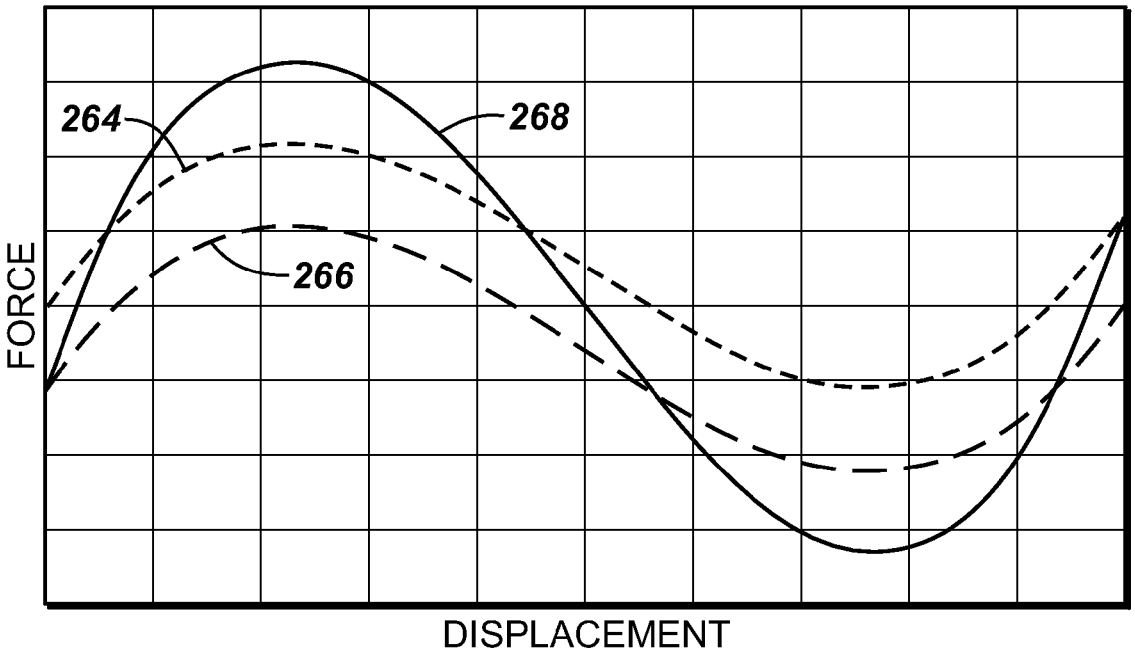
FIG. 31 is a graphical view of conical spring force versus displacement for a pair of conical springs having the general design of the conical spring illustrated in FIG. 30.

In other embodiments, spring device 260 may comprise a plurality of conical springs 262. For example, sets of two conical springs can be stacked in parallel, i.e. stacked concave-up to concave-down, to achieve a symmetric force function with respect to displacement. The graph of FIG. 31 graphically illustrates conical spring force versus displacement for a first conical spring disc (see graph line 264), a second conical spring disc (see graph line 266), and the sum of the conical spring force versus displacement for the two discs (see graph line 268). The force characteristic of the arrangement of two conical springs creates an unstable equilibrium at the momentarily closed position of the directional control valve. The direction of force applied by the conical springs changes at the midpoint of displacement, as illustrated by the graph in FIG. 31.

Figure 32:
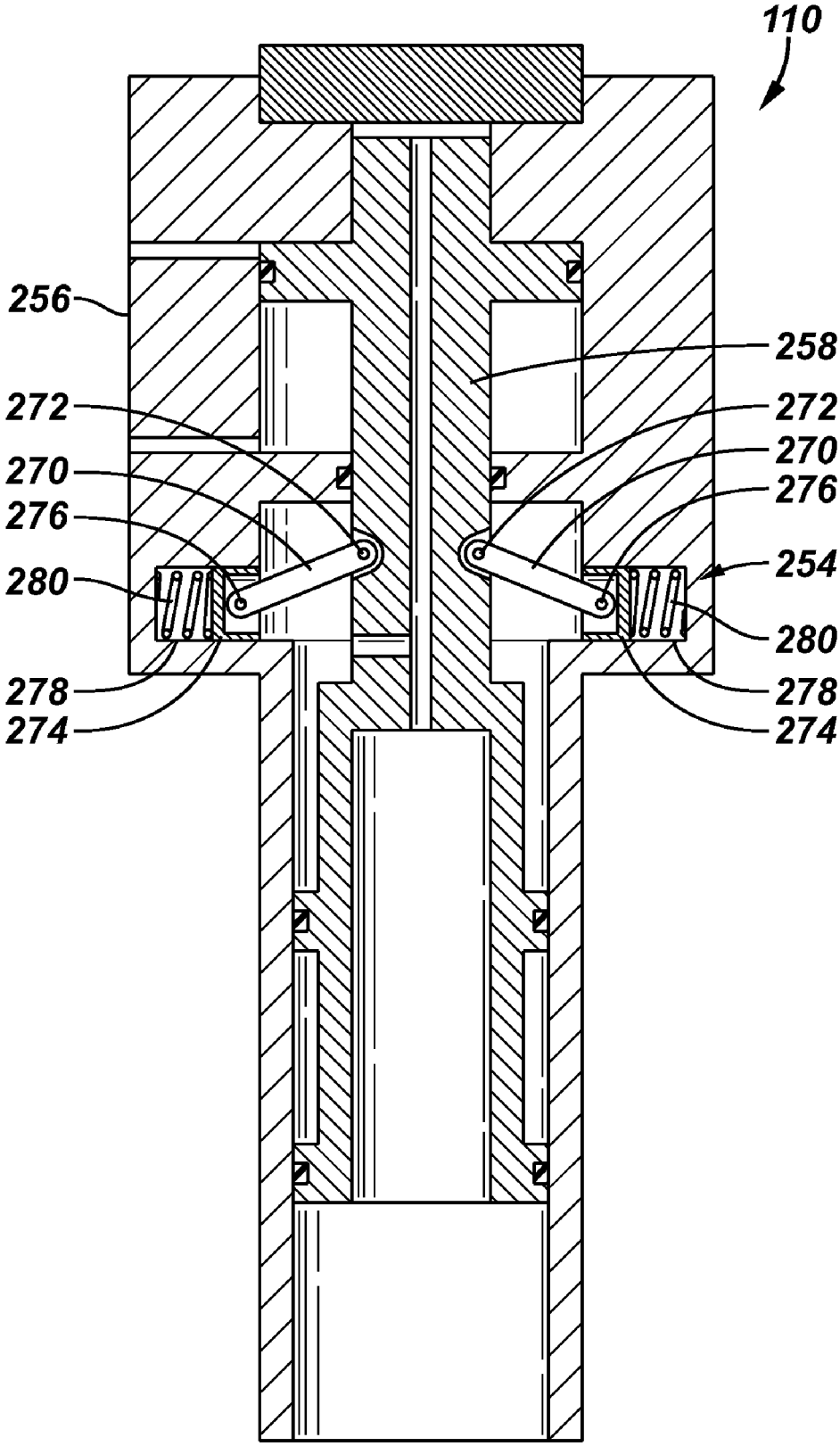
FIG. 32 is a cross-sectional view of a control valve having a spring mechanism to ensure complete switching of the control valve between operating positions, according to another embodiment of the present invention.

Another embodiment of mechanism 254 is illustrated in FIG. 32. In this embodiment, one or more connecting rods 270 are coupled between shuttling piston 258 and valve body 256. Each connecting rod 270 is pivotably connected to the shuttling piston 258 by a pivot 272. At an opposite end of each connecting rod 270, the connecting rod is pivotably coupled to a piston member 274 by a pivot 276. Each piston member 274 is slidably received in a corresponding cylinder 278 and biased toward the shuttling piston 258 by a spring member 280. The spring members 280, acting through connecting rods 270, impart a force to the shuttling piston 258 of the directional control valve. The vertical component of that force varies as a function of the displacement of the shuttling piston 258. At the travel midpoint of the shuttling piston, the direction of the vertical force component reverses, creating an unstable position. Thus, this embodiment of mechanism 254 also ensures complete switching of control valve 110. Alternatively, each connecting rod 270 can be fabricated from a material having elastic or plastic properties, e.g. plastic memory material, such that a separate spring member 280 can be omitted. In other alternate embodiments, connecting rods 270 can be formed from compliant materials and pinned or rigidly attached to both shuttling piston 258 and valve body 256.

Figure 33:
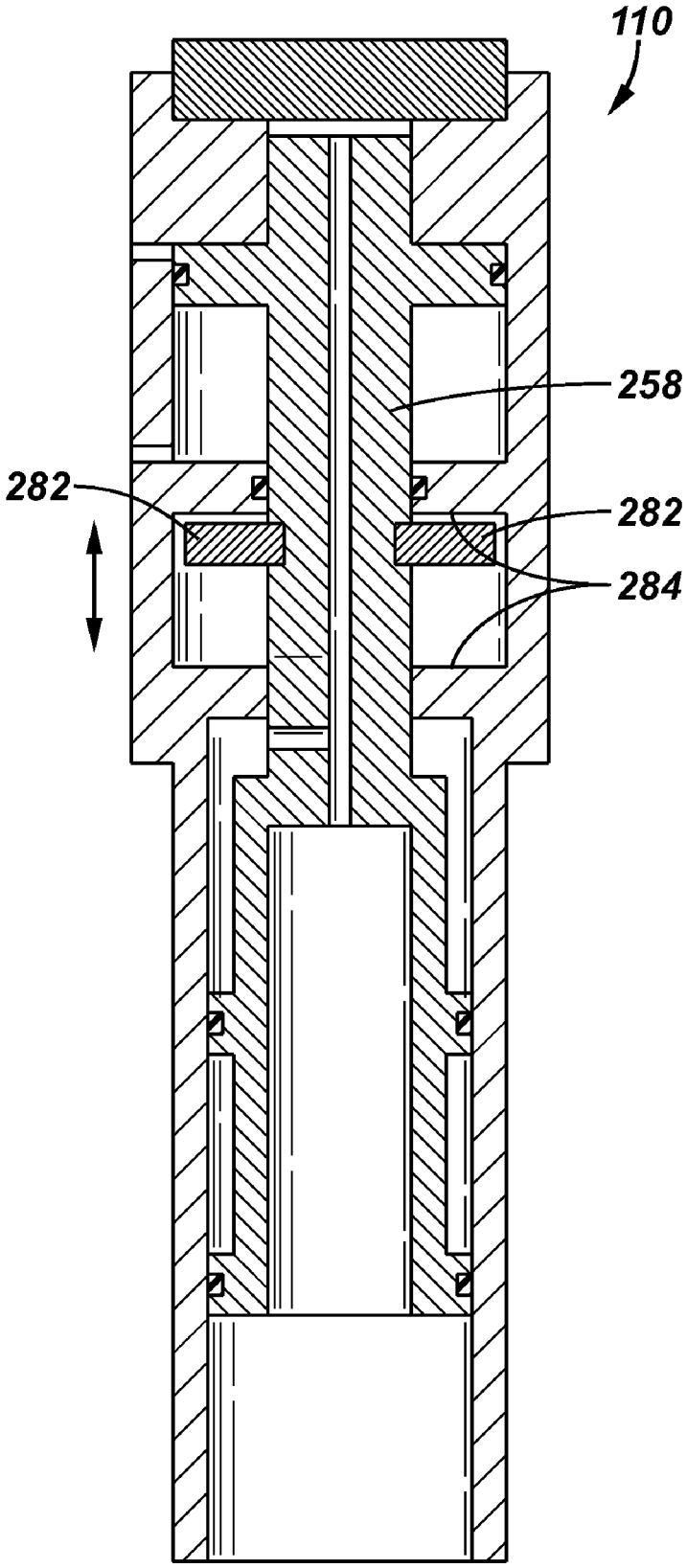
FIG. 33 is a cross-sectional view of a control valve having a spring mechanism to ensure complete switching of the control valve between operating positions, according to another embodiment of the present invention.

As illustrated in FIG. 33, the mechanism 254 for ensuring complete switching of control valve 110 also may comprise a magnetic mechanism. In this embodiment, a magnet and metallic elements are positioned in a manner that renders the momentarily closed position unstable. For example, a permanent magnet 282 may be coupled to shuttling piston 258, and metallic elements 284 may be positioned on opposite sides of permanent magnet 282 approximately equally distant from the permanent magnet when it passes through the momentarily closed position. The permanent magnet 282 is attracted to the closer of the metallic elements, rendering the momentarily closed position unstable. The permanent magnet 282 and corresponding metallic elements 284 also can be connected to other components of control valve 110 to create the same unstable position.

Figure 34:
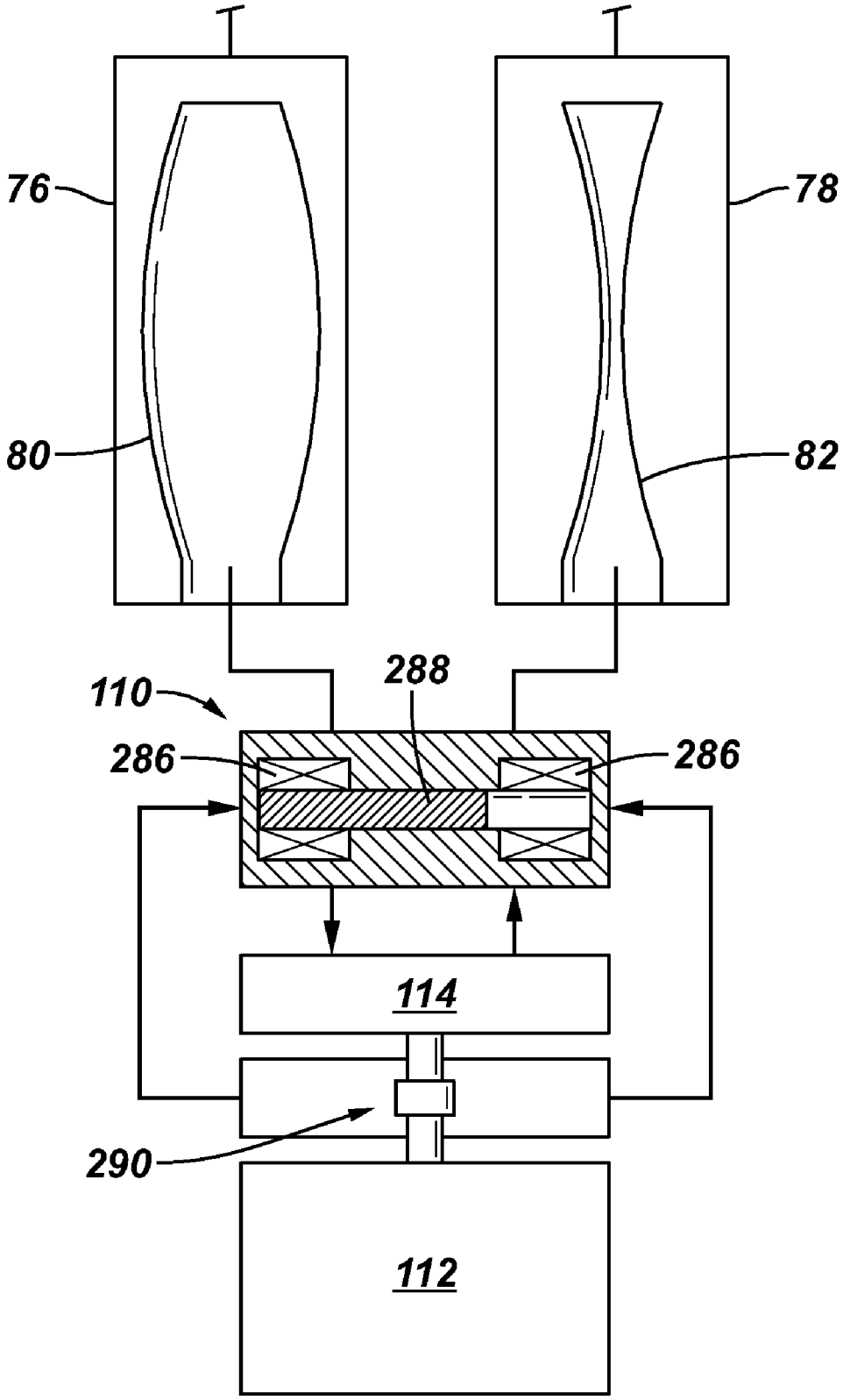
FIG. 34 is a schematic illustration of a pumping system, according to another embodiment of the present invention.

In another embodiment of pumping system completion 52, the control valve 110 comprises an electro-mechanical actuator 286, as illustrated in FIG. 34. In this embodiment, directional control valve 110 is a two state main valve having a sliding shuttle 288 that is moved back and forth to direct the flow from pump 114 to and from the expandable members 80 and 82. The sliding shuttle 288 is moved back and forth by electro-mechanical actuator 286 which can be designed to function similar to a solenoid.

The electro-mechanical actuator 286 moves sliding shuttle 288 based on electrical signals received from an appropriate control device 290. For example, control device 290 may comprise a device positioned at pump 114, prime mover 112, or adjacent a shaft between pump 114 and prime mover 112 to count pump shaft rotations. As discussed previously, the pump shaft rotations can be correlated with a pumped volume required to fill a given expandable member 80, such as a diaphragm. When the predetermined number of rotations has been counted by control device 290, an electrical signal is sent to electro-mechanical actuator 286 to move sliding shuttle 288 and thereby switch control valve 110 to another state. Control device 290 can be, for example, a frequency sensor, a Hall effect sensor, an alternator or other types of devices that can be used to determine the volume of working fluid pumped.

Figure 35:
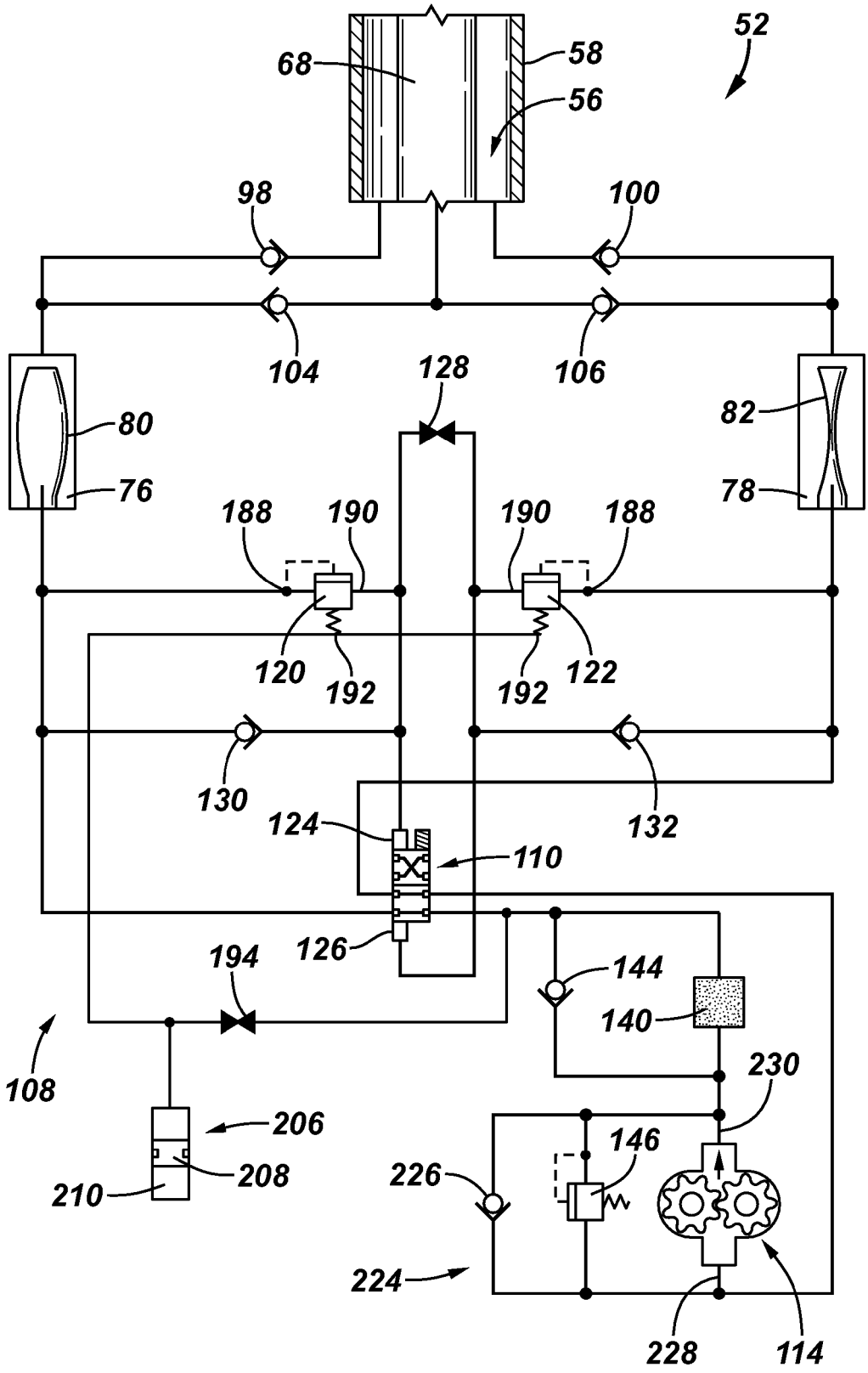
FIG. 35 is a schematic illustration of a pumping system, according to another embodiment of the present invention.

In FIG. 35, another embodiment of pumping system 52 is illustrated. In this embodiment, a compensated drain chamber system as generally described with reference to FIG. 21 is combined with a reverse flow protection system as generally described with reference to FIG. 25. The hydraulic pump 114 again is connected to control valve 110, e.g. a spool valve, through filter element 140, and pressure relief valve 146 is coupled between pump discharge side 230 and pump suction side 228 to protect the system in case of a failure restricting the flow lines. Furthermore, check valve 144 may be connected across filter 140 to protect the system in the event the filter becomes plugged.

The reverse flow protection is provided by check valve 226 connected across the pump intake or suction side 228 and the pump discharge side 230. During regular operation, check valve 226 is forced to a closed position with the pressure differential created by pump 114 and by an optional bias spring. In the case of reverse rotation of the pump, however, the high pressure at pump intake side 228 opens check valve 226 to provide a bypass. This bypass effectively short-circuits the pump without damaging the overall pumping system 52 so normal operation of the pumping system can resume when the direction of pump rotation is corrected.

In this embodiment, flow is switched between expandable members 80 and 82 by control valve 110. As described above, control valve 110 may comprise a spool valve designed to have stable equilibrium positions in each flow direction to minimize the chance of uncontrolled actuation. The control valve 110 is actuated by pressure selectively applied to pilot ports 124 and 126, and pressure to the pilot ports is controlled by sequence valves 120 and 122. The pilot ports are connected together via orifice element 128, and pressures at the pilot ports are relieved by check valves 130 and 132 connecting each port to the corresponding expandable member.

As discussed with respect to some of the embodiments described above, sequence valves 120 and 122 operate on a principle of differential pressure. When the pressure differential between the inlet port 188 and the drain port 192 of a given sequence valve exceeds a preset pressure value, communication is enabled between the inlet port 188 and the sequence port 190. In the pumping system illustrated in FIG. 35, each inlet port 188 is connected to its corresponding expandable member, and the drain ports 192 both are connected to compensated drain chamber 206. While a given sequence valve is open, a small amount of fluid is rejected into its drain port 192.

The working fluid pressure within compensated drain chamber 206 is regulated to proximity with the discharge pressure of pump 114 through orifice element 194. Orifice element 194 can be connected to either side of filter 140 and achieve comparable performance. In this particular embodiment, the pressure within compensated drain chamber 206 is compensated to a gas charge, e.g. a nitrogen charge, within chamber 210 via piston compensator 208. The pressure of the compressible nitrogen charge in chamber 210 is much less sensitive to volume change than the incompressible hydraulic working fluid. Therefore, while a given sequence valve is open, the hydraulic fluid from its drain port 192 is accommodated in the compensated drain chamber 206 without appreciable pressure increase.

As described with reference to FIG. 22, the use of drain chamber 206 creates a time dependent pressure differential between working fluid within compensated drain chamber 206 and working fluid at a location external of the compensated drain chamber, e.g. within the line pressurizing the expanded diaphragm. Effectively, the pressure in the diaphragm and its working fluid supply line increases at a greater rate than the pressure within compensated drain chamber 206 creating a pressure differential between the inlet port 188 and the drain port 192 of the corresponding sequence valve. When this pressure differential increases a sufficient amount, the corresponding sequence valve is shifted and actuates control valve 110 to its other operating state.

Figure 36:
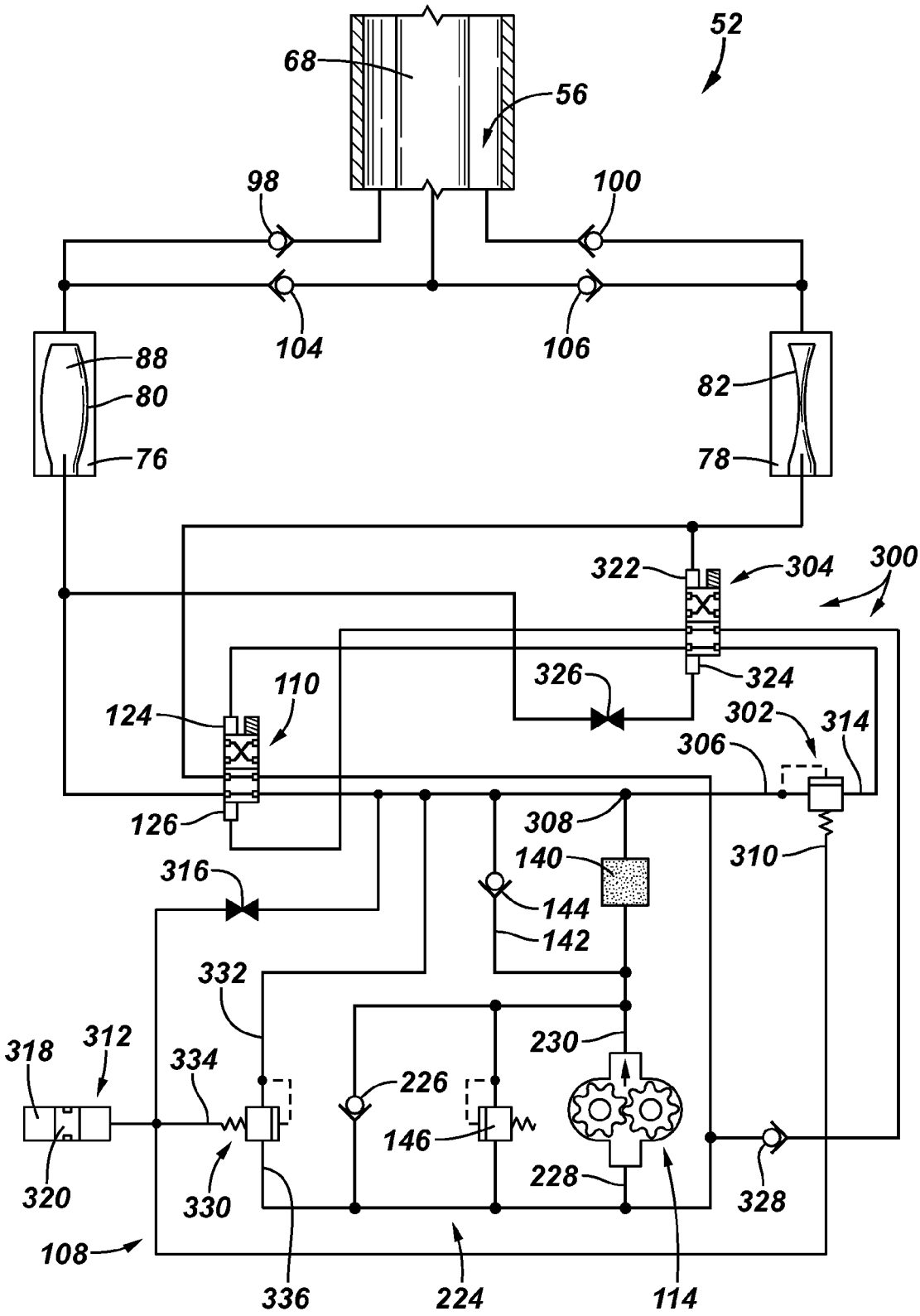
FIG. 36 is a schematic illustration of a pumping system, according to another embodiment of the present invention.

In another embodiment of pumping system 52, the hydraulic circuit 108 comprises a sensing system located upstream of the directional valve, i.e. control valve 110. As illustrated in FIG. 36, a sensing system 300 is positioned upstream of control valve 110 with respect to flow of the working fluid 88. The sensing system 300 detects changes in working fluid pressure when one or the other of expandable members 80, 82 fills its corresponding chamber, resulting in increased working fluid pressure. The sensing system 300 reacts by shifting control valve 110 via appropriate input to either pilot port 124 or pilot port 126.

In this embodiment, as with the embodiment described with reference to FIG. 17, the pumping system 52 may comprise prime mover 112, e.g. an electric motor, that powers the hydraulic, working fluid pump 114. Pump 114 is used to provide working fluid flow to expandable members 80 and 82, while the hydraulic network 108 disposed within hydraulic control module 188 controls the alternating flow of working fluid in and out of expandable members 80 and 82. Generally, expandable member 80 is filled during the first half of a pumping cycle while expandable member 82 is drained; and expandable member 82 is filled during the second half of the pumping cycle while expandable member 80 is drained. Additional components or other arrangements of components also can be used in constructing pumping system 52.

As illustrated in FIG. 36, the working fluid hydraulic network 108 may again be designed so that working fluid pump 114 is coupled to control valve 110 through filter 140. In this embodiment, control valve 110 also may again be constructed as a spool valve shiftable between flow positions, e.g. a two-stage spool valve. Pressure relief valve 146 is connected across pump 114 to protect the system in the event of a failure or blockage that restricts the flow lines. Check valve 144 also may be connected across filter element 140 to protect the system against pressure buildup if, for example, filter 140 becomes plugged. Normally check valve 144 is closed, but the check valve opens to create an alternate path upon sufficient pressure buildup.

Similar to operation of several embodiments discussed above, working fluid 88 is reciprocated between expandable members 80 and 82 by control valve 110 which may be in the form of a spool valve. The spool valve may be constructed with stable equilibrium positions in each flow direction to minimize chances of uncontrolled actuation. Control over the spool type control valve 110 is exercised by pressure applied to pilot ports 124 and 126. As with embodiments described above, check valves 98 and 100 may be deployed between the expandable members 80, 82 and well fluid in wellbore 56. Check valves 104, 106 may be deployed between the expandable members and the pumped well fluid in, for example, tubing 68. The check valves 98, 100, 104 and 106 facilitate the pumping action of expandable members 80, 82 as well fluid is produced.

This embodiment of pumping system 52 also may comprise reverse flow protection system 224 that uses check valve 226 connected across working fluid pump 114 between its suction side 228 and its discharge side 230. In regular operation, check valve 226 is forced in the closed position with a pressure differential and an optional bias spring. However, in the event of reverse rotation of pump 114, high pressure at the intake port of pump 114 opens check valve 226. The created bypass path prevents system function, effectively short-circuiting pump 114. Pumping system 52 is able to resume regular operation when the direction of pump rotation is corrected.

In the embodiment illustrated in FIG. 36, upstream sensing system 300 comprises a sequence valve 302 and a spool valve 304 both positioned on an upstream side of control valve 110 with respect to the flow of working fluid 88 through control valve 110. Sequence valve 302 comprises an inlet port 306 coupled to a pressure port 308 of hydraulic network 108 located between control valve 110 and filter 140 (as illustrated in FIG. 36) or between filter 140 and pump 114. Sequence valve 302 also comprises a drain port 310 connected to a drain chamber 312 and a sequence port 314 connected to spool valve 304.

The drain chamber pressure is regulated to proximity with the discharge pressure of pump 114 through an appropriate flow restrictor or choke element 316, such as an orifice. The restrictor 316 typically is positioned in hydraulic network 108 on the same side of filter 140 as pressure port 308. This avoids undesirable pressure differences that can result from filter clogging. However, restrictor 316 can be positioned on an opposite side of filter 140. The pressure in drain chamber 312 may be compensated to the pressure of a compressed gas 318 on an opposite side of a piston 320 sealably mounted within drain chamber 312. The compensated drain chamber serves as a reservoir to working fluid drained from sequence valve 302 during operation of the sequence valve. The gas charge is used to reduce the effective bulk modulus of the drain chamber, however the same effect can be achieved through other mechanisms.

When the pumping cycle begins and expandable member 80 is filled with a working fluid, the pressure in drain chamber 312 closely follows the pressure within expandable member 80, e.g. diaphragm 80, via communication established through flow restrictor 316. As the expandable member 80 contacts the surrounding elements of chamber 76, the pressure within expandable member 80 along with the discharge pressure of working fluid pump 114 increases at a greater rate. The flow restrictor 316 is sized such that the flow therethrough, e.g. the flow through an orifice, is not sufficient to follow the greater rate of increase without significant pressure drop. (See the graphical illustration in FIG. 22). The restricted flow creates a pressure differential between the discharge pressure of pump 114 and the pressure at drain chamber 312. The pressure differential acts on sequence valve 302 to cause a sequencing of sequence valve 302 such that the pressure of the working fluid passes through sequence port 314 of sequence valve 302 and through spool valve 304. The pressure input passes through spool valve 304 to the appropriate pilot port of control valve 110 and shifts control valve 110 to initiate filling of the other expandable member, e.g. expandable member 82. During filling of the expandable members 80, 82, the pressurized fluid in drain chamber 312 is allowed to bleed until the pressure approximates pump discharge pressure. Control valve 110 is repeatedly shifted upon receiving the appropriate pressure inputs from sensing system 300 so that working fluid is cycled back and forth between the expandable members.

Spool valve 304 is used to control which pilot port 124 or 126 of control valve 110 is exposed to the pressurized working fluid passing through sequence valve 302. This ensures that control valve 110 is shifted correctly to enable the continued reciprocation of working fluid between expandable members 80 and 82.

As illustrated, spool valve 304 is connected in series with sequence valve 302 and comprises pilot ports 322 and 324 that enable shifting of spool valve 304 between different flow positions based on pressure applied to either pilot port 322 or pilot port 324. During a pumping operation, the expandable member which has been filled within its surrounding chamber is under high tubing pressure whereas the empty or drained expandable member is under a lower casing pressure. Each pilot port of spool valve 304 is linked separately to a corresponding expandable member. For example, in the illustrated embodiment, pilot port 322 is connected in fluid communication with expandable member 82, and pilot port 324 is connected in fluid communication with expandable member 80. Accordingly, spool valve 304 is shifted to a determined fluid flow configuration as each expandable member is filled. For example, the filling of expandable member 80 shifts spool valve 304 to one fluid flow configuration, as illustrated, and the filling of expandable member 82 shifts spool valve 304 to a second fluid flow configuration. When a sequencing event, i.e. sequencing of sequence valve 302, occurs, the position of spool valve 304 determines which pilot port of control valve 110 is pressurized. As a result of the pressurization of pilot port 124 or pilot port 126, control valve 110 is shifted and the filling of expandable members 80, 82 is reversed. This reversal then causes spool valve 304 to shift back to its opposite state in preparation for the next cycle.

A restrictor 326, e.g. an orifice, may be positioned between one of the pilot ports 322, 324 and its corresponding expandable member 82, 80. Alternatively, restrictors 326 can be positioned in series between both pilot ports 322 and 324 and their corresponding expandable members 82 and 80, respectively. The one or more restrictors 326 delay the response time of spool valve 304 to a desired level. With certain system designs, the action of the spool valve may be quicker than desired, so one or more restrictors 326 can be used to slow the spool valve action.

In the illustrated embodiment, the pilot port of control valve 110 that is not pressurized during a shift cycle is placed in fluid communication with the suction side 228 of pump 114 through spool valve 304 and a check valve 328. For example, if pilot port 124 is to be pressurized for shifting of control valve 110, then pilot port 126 is in fluid/pressure communication with the pump suction side 228 through both spool valve 304 and check valve 328. Check valve 328 effectively protects the pilot port, e.g. pilot port 126, from intake pressure dynamics that can occur during shifting of control valve 110.

A secondary sequence valve 330 may be used for limiting the pressure to which expandable members 80, 82 are exposed. Secondary sequence valve 330 normally is set at a higher pressure differential threshold compared to the primary sequence valve 302. Secondary sequence valve 330 comprises an inlet port 332 in fluid communication with the output of working fluid pump 114 through filter 140 or directly in fluid communication with the output of pump 114. Secondary sequence valve 330 further comprises a drain port 334 in fluid communication with drain chamber 312, and a sequence port 336 in fluid communication with the suction side 228 of working fluid pump 114. If the discharge pressure through filter 140 (or from pump 114 if connected directly to the output of pump 114) exceeds the pressure exerted by drain chamber 312 by more than a set pressure, secondary sequence valve 330 opens to enable flow through sequence port 336. Thus, secondary sequence valve 330 protects hydraulic network 108 and the overall pumping system during, for example, system startup and during system anomalies that can result due to an undesired response from a system component.

The embodiments described above provide examples of a submersible pumping system having a unique, efficient and dependable design for use in a variety of pumping applications, including the pumping of hydrocarbon based fluids. It should be noted that different arrangements and different types of components can be incorporated into the submersible pumping system. For example, different types of expandable members and valves can be used in a variety of pumping system configurations, depending on the specific type of application for which the pumping system is designed.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system to pump fluid in a wellbore, comprising:

a pump housing with a fluid inlet and a fluid outlet, the pump housing having a pair of chambers;

a pair of expandable members with one of the expandable members deployed in each chamber of the pair of chambers;

a working fluid; and a hydraulic control system to control reciprocation of the working fluid from one expandable member to the other, the resulting sequential contraction and expansion of the expandable members drawing well fluid into one chamber while well fluid is discharged from the other chamber, the reciprocation being controlled via a control valve shifted between flow positions by a sensing system having a plurality of sequence valves which shift the control valve when a predetermined pressure differential is sensed between the working fluid pressure and the pressure of the pumped well fluid.

2. The system as recited in claim 1, wherein the sequence valve is located upstream of the control valve with respect to flow of the working fluid.

3. The system as recited in claim 1, wherein each expandable member comprises a diaphragm.

4. The system as recited in claim 1, wherein the control valve comprises a two-stage spool valve.

5. The system as recited in claim 1, further comprising a reverse direction protection system.

6. The system as recited in claim 1, wherein the control valve comprises a first pilot port in fluid communication with one of the expandable members and a second pilot port in fluid communication with the other of the expandable members.

* * * * *